US010398181B2

(12) United States Patent
Tiffin

(10) Patent No.: US 10,398,181 B2
(45) Date of Patent: Sep. 3, 2019

(54) ILLUMINATED GLOVE

(71) Applicant: Mangata, LLC, Lewisburg, PA (US)

(72) Inventor: Mary Tiffin, Windfield, PA (US)

(73) Assignee: Mangata, LLC, Lewisburg, PA (US)

( * ) Notice: Subject to any disclaimer, the term of this patent is extended or adjusted under 35 U.S.C. 154(b) by 85 days.

(21) Appl. No.: 15/838,523

(22) Filed: Dec. 12, 2017

(65) Prior Publication Data

US 2019/0166933 A1 Jun. 6, 2019

Related U.S. Application Data

(63) Continuation-in-part of application No. 15/644,918, filed on Jul. 10, 2017, now Pat. No. 9,839,244, which
(Continued)

(51) Int. Cl.
*F21V 21/08* (2006.01)
*A41D 19/015* (2006.01)
(Continued)

(52) U.S. Cl.
CPC ..... *A41D 19/0157* (2013.01); *A41D 19/002* (2013.01); *A41D 19/0013* (2013.01);
(Continued)

(58) Field of Classification Search
CPC ..... A41D 19/002; A41D 19/01547; A41D 19/0157; A41D 27/205; F21V 23/023; F21V 23/04; F21V 33/008
(Continued)

(56) References Cited

U.S. PATENT DOCUMENTS 3,638,011 A 1/1972 Bain et al.
4,625,339 A 12/1986 Peters
(Continued)

FOREIGN PATENT DOCUMENTS

JP 50-30930 U 4/1975
JP 50-35422 U 4/1975
(Continued)

OTHER PUBLICATIONS

Int'l Search Report and Written Opinion dated May 10, 2016 in Int'l Application No. PCT/US2016/014301.
(Continued)

*Primary Examiner* — Jason M Han
(74) *Attorney, Agent, or Firm* — Panitch Schwarze Belisario & Nadel LLP

(57) ABSTRACT

An illuminated glove assembly includes a glove and an illumination data controller. The glove has a body portion, a longitudinal glove axis, a pointer extension, a pinky extension, a wrist strap and a pocket portion. The wrist strap is positioned at a proximal end of the body portion. A securing mechanism is connected to the wrist strap and the pointer extension and pinky extension extend from a distal end of the body portion. The pointer extension is positioned on a first side of the longitudinal axis and the pinky extension is positioned on a second side of the longitudinal axis. The pocket portion is secured to and defines a pocket with the body portion. An opening of the pocket is defined proximate the distal end of the body. The illumination data controller is configured for selective mounting in the pocket and includes a housing with a front face.

20 Claims, 23 Drawing Sheets

Related U.S. Application Data is a continuation-in-part of application No. 15/435,578, filed on Feb. 17, 2017, now Pat. No. 9,700,087, which is a continuation-in-part of application No. 15/003,053, filed on Jan. 21, 2016, now Pat. No. 9,572,384.

(60) Provisional application No. 62/107,007, filed on Jan. 23, 2015.

(51) Int. Cl.

| | |
|---|---|
| ***A41D 19/00*** | (2006.01) |
| ***A41D 19/01*** | (2006.01) |
| *F21L 4/00* | (2006.01) |
| *F21Y 115/10* | (2016.01) |
| *F21L 13/00* | (2006.01) |

(52) U.S. Cl.

CPC ..... *A41D 19/0024* (2013.01); *A41D 19/0048* (2013.01); *A41D 19/01* (2013.01); *A41D 2300/22* (2013.01); *A41D 2400/80* (2013.01); *A41D 2500/50* (2013.01); *F21L 4/00* (2013.01); *F21L 13/00* (2013.01); *F21Y 2115/10* (2016.08)

(58) Field of Classification Search

USPC ..... 362/103

See application file for complete search history.

(56) References Cited

U.S. PATENT DOCUMENTS

| | | | |
|---|---|---|---|
| 5,088,121 | A | 2/1992 | Wallace |
| D335,368 | S | 5/1993 | Houston |
| 5,214,799 | A | 6/1993 | Fabry |
| 5,345,368 | A | 9/1994 | Huff |
| D362,927 | S | 10/1995 | McCrane |
| 5,500,956 | A | 3/1996 | Schulkin et al. |
| 5,535,105 | A | 7/1996 | Koenen et al. |
| 5,580,154 | A | 12/1996 | Coulter et al. |
| 5,581,809 | A | 12/1996 | Mah |
| D382,087 | S | 8/1997 | Arshed |
| 5,816,676 | A | 10/1998 | Koenen Myers et al. |
| D417,312 | S | 11/1999 | Hoefs |
| 6,529,121 | B2 | 3/2003 | Bush |
| 6,711,746 | B1 | 3/2004 | Orellana |
| 6,892,397 | B2 | 5/2005 | Raz et al. |
| D516,234 | S | 2/2006 | Holsinger et al. |
| 7,013,490 | B2 | 3/2006 | Senter et al. |
| D528,676 | S | 9/2006 | Leslie et al. |
| 7,152,248 | B2 | 12/2006 | Ziemer |
| D544,119 | S | 6/2007 | Ding et al. |
| D548,384 | S | 8/2007 | Komar |
| D566,311 | S | 4/2008 | Schnell |
| D567,453 | S | 4/2008 | Fincher |
| D571,051 | S | 6/2008 | Matthews |
| D578,691 | S | 10/2008 | Lau |
| D590,531 | S | 4/2009 | Ma |
| D606,688 | S | 12/2009 | Ma |
| D608,035 | S | 1/2010 | Lee |
| D615,227 | S | 5/2010 | Hine et al. |
| 8,562,165 | B2 | 10/2013 | Thompson et al. |
| D705,493 | S | 5/2014 | Steinberg et al. |
| D747,559 | S | 1/2016 | Faulkner |
| D790,099 | S | 6/2017 | Pius |
| D794,238 | S | 8/2017 | Kung |
| D799,085 | S | 10/2017 | Huang |
| 2007/0039083 | A1 | 2/2007 | Williams |
| 2009/0168407 | A1 | 7/2009 | Wright |
| 2011/0258752 | A1 | 10/2011 | Matheney, II et al. |
| 2012/0081884 | A1 | 4/2012 | Gonzalez |
| 2013/0265788 | A1 | 10/2013 | O'Maley et al. |
| 2016/0215970 | A1 | 7/2016 | Tiffin |
| 2017/0156423 | A1 | 6/2017 | Tiffin |

FOREIGN PATENT DOCUMENTS

| | | | |
|---|---|---|---|
| JP | H05140803 | A | 6/1993 |
| JP | H07324209 | A | 12/1995 |
| JP | 2002218769 | A | 8/2002 |
| JP | 200444053 | A | 2/2004 |
| JP | 3114125 | U | 9/2005 |
| JP | 3157330 | U | 2/2010 |
| WO | 2007007211 | A2 | 1/2007 |
| WO | 2011031536 | A1 | 3/2011 |

OTHER PUBLICATIONS

Int'l Search Preliminary Report on Patentability dated Aug. 3, 2017 in Int'l Application No. PCT/US2016/014301.

Runlites, Jan. 6, 2016, downloaded from web page: https://www.facebook.com/Runlites/photos/, Downloaded date: Mar. 27, 2017, 1 pg.

GripGrab SuperGel Short Finger Gloves, Wiggle.co.uk, May 5, 2014 , downloaded from web page: http://www.wiggle.co.uk/gripgrab-supergel-short-finger-gloves/, Download date: Mar. 27, 2017, 1 pg.

Gore Bike Wear Oxygen Short Finger Gloves, Wiggle.co.uk, Feb. 17, 2013, downloaded from webpage: http://www.wiggle.co.uk/gore-bike-wear-oxygen-short-finger-gloves, Download date: Mar. 27, 2017, 1 page.

Sibertron Men's Black S.o.l.a.g., Amazon.com, Sep. 23, 2014, https://www.amazon.com/Seibertron-Special-Assault-Tactical-Fingerless/dp/B01M0QI7TH/ref=sr_1_sc_2?ie=UTF8&qid=1507312565&sr=8-2-spell&keywords=seiberton+men%27s+black+S.o.la.g.+special+Ops, Download Date: Mar. 27, 2017, 1 page.

Office Action dated May 8, 2017 in U.S. Appl. No. 29/555,594, by Tiffin.

ILLUMINATED GLOVE

CROSS-REFERENCE TO RELATED APPLICATIONS

The present application is a continuation-in-part application of U.S. patent application Ser. No. 15/644,918, filed on Jul. 10, 2017 and titled, "Illuminated Glove Assembly," which is a continuation-in-part application of U.S. patent application Ser. No. 15/435,578, now U.S. Pat. No. 9,700,087, filed on Feb. 17, 2017 and titled "Illuminated Glove Assembly," which is a continuation-in-part application of U.S. patent application Ser. No. 15/003,053, now U.S. Pat. No. 9,572,384, filed on Jan. 21, 2016 and titled, "Illuminated Glove Assembly" and claims the benefit of U.S. Provisional Patent Application No. 62/107,007, filed on Jan. 23, 2015 and titled "Illuminated Running Gloves" the entire contents of which are incorporated herein by reference in their entirety.

BACKGROUND OF THE INVENTION

The preferred invention relates generally to illuminated gloves and, more particularly, to an illuminated gloves assembly that illuminates a wearer's path while worn when ambient light is minimal. The preferred illuminated gloves may be particularly adapted for runners, cyclists, athletes, outdoorsmen, survivalists, carpenters, plumbers, mechanics, tree trimmers, utility or maintenance workers, security or law enforcement officers, children, everyday use or for any situation where the user or wearer desires light projecting from their hands. The preferred glove assembly includes an illuminated data controller that provides illumination, sensors and wireless communication capabilities.

Gloves that provide a light source to allow a wearer to accomplish a variety of tasks are known. Generally, such gloves are configured to have a reflective strip or a light diffuser that makes the wearer more visible in conditions where ambient light is poor, but do not provide sufficient light to aid the wearer's vision. Alternately, other gloves are configured to house a light source which illuminates the area immediately in front of the wearer's hand or fingers to aid in performing tasks that require the use of each of the wearer's fingers and/or hands, but similarly do not provide sufficient light to illuminate a great enough area to enable a runner to see more than a very short distance in front of him or her while ambient light is low. These gloves also generally do not provide the ability to charge the lights while the user is wearing the gloves or the recharge the lights at all, relying on disposable batteries. Known gloves are also configured to display particular symbols, are relatively cumbersome and lack other features that are desired by users for illuminating a desired area or accommodating various additional accessories while providing a low profile, comfortable and efficient operation and appearance. Such prior art gloves also lack a convenient way to remove and replace the light for use of the gloves without the light and to readily replace the battery associated with the light. These prior art gloves further lack storage pockets or storage features for retaining the wearers items, such as keys, currency, communication devices, energy packs, the light and other relatively modest sized personal items of the user.

Runners, cyclists, skiers and outdoorsman often exercise or are otherwise outside early in the morning or late in the evening, such as before and after work (particularly in winter seasons or when days are short), when there is low light or it is dark. Reflective vests and brightly colored gear have been developed to improve safety for these individuals, but these items do not project light for the user's safety or as a warning of the location of the user to others. These products also do not provide for the combination of reflective properties on the materials of the product, which is included with the preferred present invention, in combination with the light to project light from the preferred gloves. In addition, outdoorsman may desire light while moving in the dark, but also desire camouflage when remaining stationary to prevent scaring wildlife.

Alternative prior art illumination devices also include flashlights or headlamps that must be carried consistently by hand or require the user to turn their head to project the light in desired directions, respectively. The prior art flashlights, headlamps or other lights often shift during use, thereby projecting light in undesirable directions and requiring annoying readjustment by the user. These prior art flashlights, headlamps or other lights are also inconvenient or uncomfortable to carry, wear and project light in a desired direction, such as a headlamp squeezing the user's head and sliding on the user's head. Prior art vests may also incorporate lights or lights may be clipped onto a user's clothing, but such lights are also difficult to direct without awkward body movements and such light may be lost and misplaced. Further, flashlights or other handheld lights require occupation of one of the user's hands, thereby reducing the ability of the user to use their occupied hand to complete desired tasks.

It is therefore, desirable to design, develop, manufacture and distribute a glove that provides sufficient light in front of the wearer to enable him or her to see his or her path in conditions with minimal ambient light while simultaneously not restricting the wearer's hands and/or fingers and including adaptability for various accessories or carrying relatively small items and safety features (alarms, et al.). Illuminated gloves of the preferred invention replace clunky and uncomfortable head lamps, light-up vests, clip-on lights, and other handheld lights that limit the use of your hands.

BRIEF SUMMARY OF THE INVENTION

Briefly stated, a preferred embodiment of the present invention is directed to a digitally configured glove having light sources, preferably light-emitting diodes ("LED"), housed within a housing mounted to the back portion of the glove. The light sources are configured to illuminate a sufficient distance in front of the wearer to enable him or her to see a path or other running surface when ambient light is low. The light sources are preferably comprised of an illumination data unit that is rechargeable.

In another preferred embodiment, the present invention is directed to an illuminated glove assembly for providing illumination to a user. The illuminated glove assembly includes a glove having a hand portion with a first pocket and an illumination data controller for selective mounting in the first pocket. The hand portion includes a back portion, fingers, a wrist end and a palm portion. The back portion includes the first pocket, which has a first opening proximate the fingers and a first terminal end proximate the wrist end. The illumination data unit includes a housing with a front face, a top surface, a length, a width and a thickness. The front face includes a lens from which light emanates. The width of the illumination data controller is greater than the thickness. The illumination data controller or unit is preferably mounted in the first pocket such that the direction of the light emanating from the lens may be adjusted relative to the user's hand in a mounted configuration, such that the light is generally directed anywhere from over the user's pointer to pinky fingers or between the thumb and pointer finger.

In an additional preferred embodiment, the present invention is directed to an illuminated glove assembly for providing illumination to a user. The illuminated glove assembly includes a glove having a hand portion with a back portion having a connection mechanism, fingers and a thumb and an illumination data controller configured for selective mounting to the glove via the connection mechanism. The hand portion also includes a wrist end and a palm portion. The illumination data controller has a housing with a front face, a top surface, a control button on the top surface, a length, a width and a thickness. The front face includes an arcuate lens from which light emanates. A plurality of light emitting diodes is positioned within the housing to project light out of the arcuate lens.

In a further preferred embodiment, the present invention is directed to an illuminated glove assembly having a glove and an illumination data controller. The glove has a body portion, a longitudinal glove axis, a pointer extension, a pinky extension, a wrist strap and a pocket portion. The wrist strap is positioned at a proximal end of the body portion. A securing mechanism is connected to the wrist strap and the pointer extension and pinky extension extend from a distal end of the body portion. The pointer extension is positioned on a first side of the longitudinal axis and the pinky extension is positioned on a second side of the longitudinal axis. The pocket portion is secured to and defines a pocket with the body portion. An opening of the pocket is defined proximate the distal end of the body. In the mounted position on the user's hand, the opening of the pocket is preferably positioned near the user's knuckles between the thumb and pointer finger. The illumination data controller is configured for selective mounting in the pocket and includes a housing with a front face.

BRIEF DESCRIPTION OF THE SEVERAL VIEWS OF THE DRAWINGS

The foregoing summary, as well as the following detailed description of the preferred invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
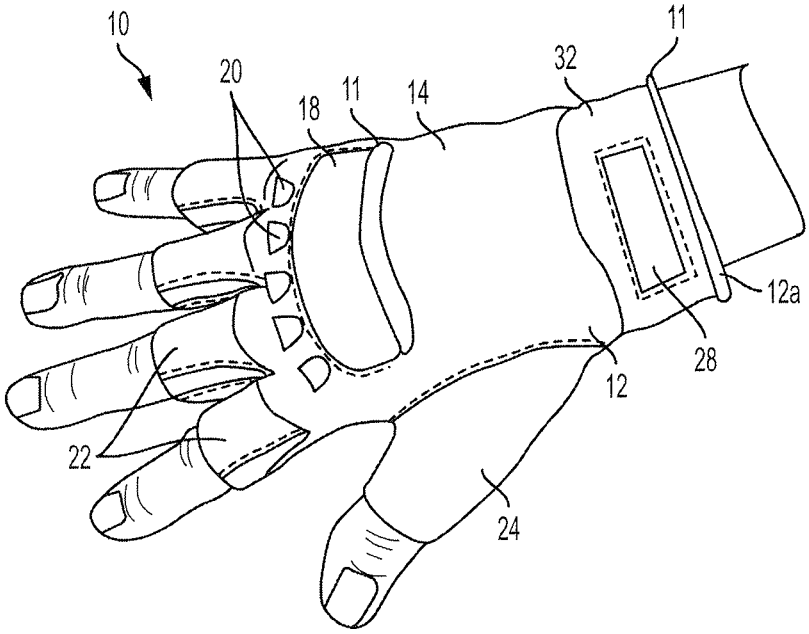
FIG. 1 is a top plan view of an illuminated right-handed glove in accordance with a first preferred embodiment of the present invention, wherein the glove is positioned on a user's/runner's hand.

Certain terminology is used in the following description for convenience only and is not limiting. Unless specifically set forth herein, the terms "a", "an", and "the" are not limited to one element but instead should be read as meaning "at least one." The words "right", "left", "lower", and "upper" designate directions in the drawings to which reference is made. The words "inwardly" or "distally" and "outwardly" or "proximally" refer to directions toward and away from, respectively, the geometric center or orientation of the device and related parts thereof. The terminology includes the above-listed words, derivatives thereof and words of similar import.

It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally the same or similar, as would be understood by one having ordinary skill in the art. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 2:
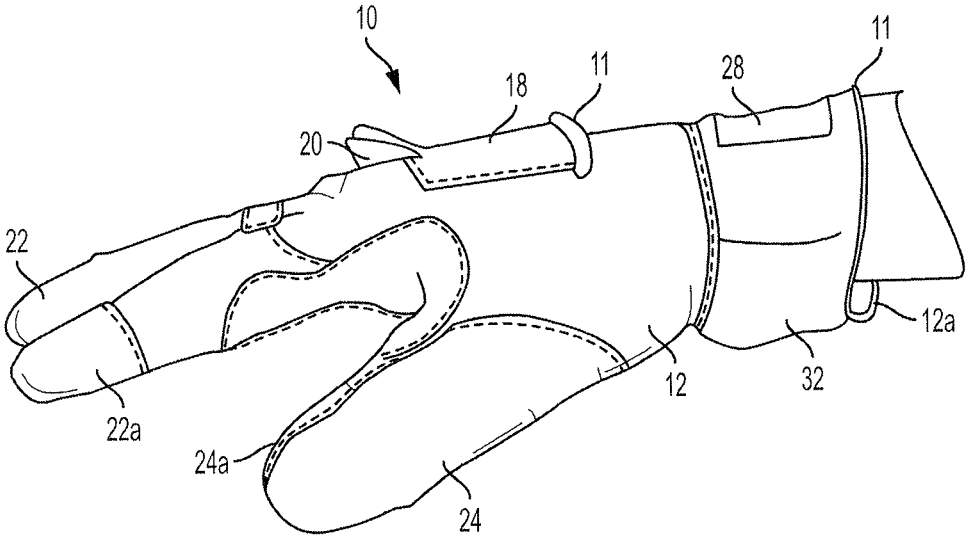
FIG. 2 is a side perspective view of the illuminated glove of FIG. 1.
Figure 3:
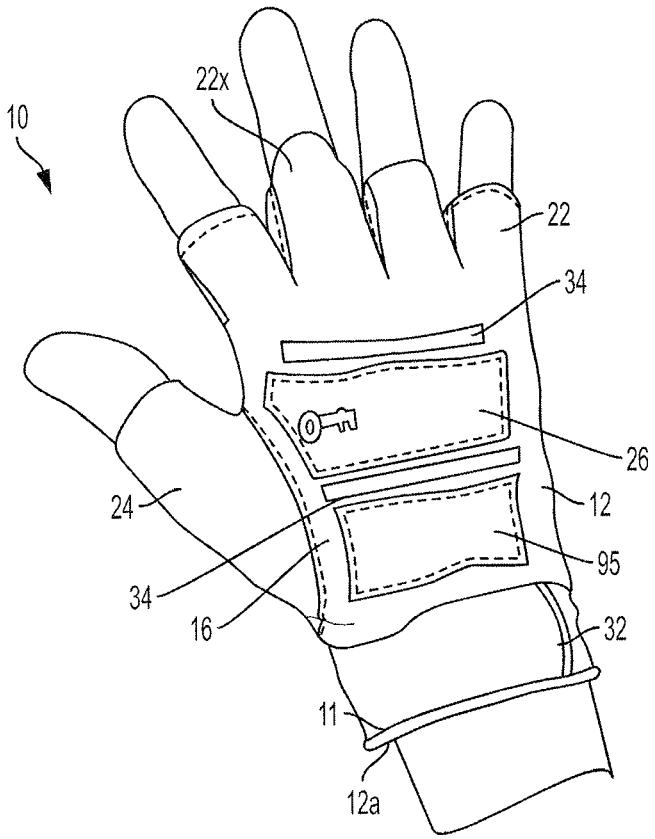
FIG. 3 is a bottom plan view of the illuminated glove of FIG. 1, but is a left-handed version of the preferred glove.
Figure 4A:
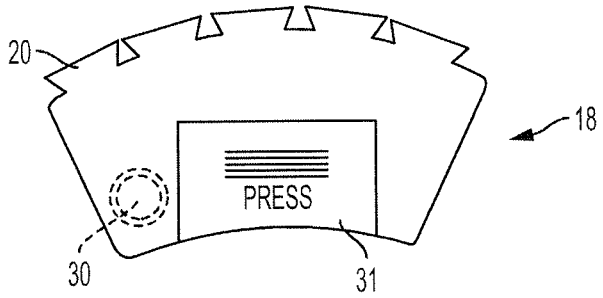
FIG. 4A is a bottom plan view of an illumination data controller for the illuminated glove of FIG. 1.
Figure 4B:
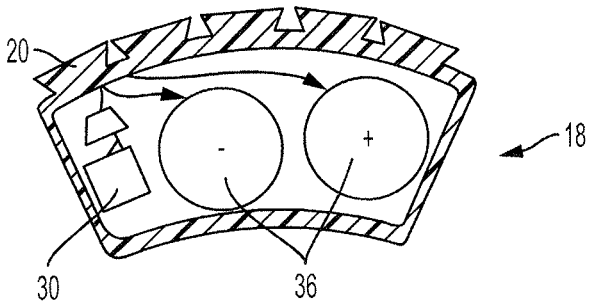
FIG. 4B is a cross-sectional view of the illumination data controller of FIG. 4A, taken on a plane parallel to the bottom plan view of FIG. 4A.
Figure 5:
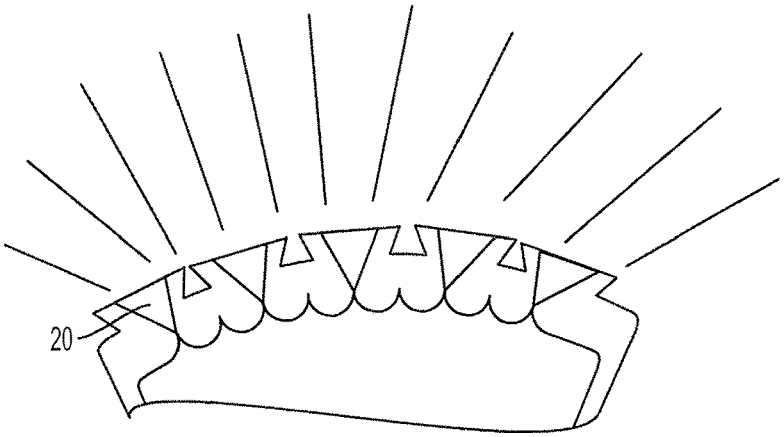
FIG. 5 is a top plan view of a first preferred lens of the illumination data controller of FIG. 4A.

Referring to FIGS. 1-3, an illuminated glove 10 in accordance with a first preferred embodiment is used to illuminate a runner's path while the available ambient light is low. One skilled in the art will appreciate that the illuminated glove 10 is not limited to use while running, but is also useful for any activity wherein the wearer requires artificial lighting to supplement low ambient light. The illuminated glove 10 may be employed by any user who desires lighting while wearing the gloves 10, such as cyclists, athletes, outdoorsmen, survivalists, everyday users and other similar users. The illuminated glove 10 preferably includes a hand portion 12, which further includes a back portion 14 and a palm portion 16. The back portion 14 preferably includes a housing 18 integrally mounted thereto. The housing 18 further preferably including at least two light sources 20. The light sources 20 are preferably configured to cast light at least ten feet (10'), and more preferably at least thirty five feet (35'), in front of the wearer and are preferably comprised light emitting diodes ("LED"). The light sources 20 are not limited to being comprised of LEDs and may be comprised of nearly any lighting component that is able to take on the general size and shape of the light sources 20, withstand the normal operating conditions of the light sources 20 and illuminate an area around the user during operation. The light sources 20 can also be configured to activate in a blinking or flashing pattern to improve the wearer's ability to be seen. It will be understood by one skilled in the art that the light sources 20 are not necessarily LEDs, but can be any device capable of producing sufficient light in front of the wearer to illuminate his or her path, such as incandescent, fluorescent, or halogen light bulbs, illuminating chemicals contained in a housing and the like.

The light sources 20 are not limited to being integrally mounted to the back portion 14 and may be mounted in other portions of the glove 10 or may be otherwise secured to the glove 10. For example, the housing 18 may be comprised of a pocket into which the light sources 20 are mounted for use. The housing 18 and light sources 20 may comprise an illumination data controller that is, as described, separate from the glove 10 and may be removed from the glove 10 for washing, use of the glove 10 without the light sources 20, replacement of the battery 36 or for other like reasons. In the first preferred embodiment, the housing 18 includes a removable door 31 that is selectively removably from the housing 18 to expose the battery 36. The battery 36 is preferably, removably mountable proximate the removable door 31, such as beneath the door 31 and the door 31 may be configured to urge the battery 36 into a mounted configuration to ensure electrical connection with the electronics components in the housing 18. The door 31 may also be comprised of hinged door the is connected to the housing 18 and generally does not fall away from the housing 18, but is retained on the housing 18 when the user opens the door 31 via the hinge mechanism. The hinged door 31 configuration is preferred in certain embodiments to prevent loss of the door 31 when the user removes the door to replace the battery 36 or otherwise removes or opens the door 31.

The illuminated glove 10 of the first preferred embodiment is preferably constructed of any breathable, soft, and flexible material that provides sufficient durability for the wearer to machine wash the glove 10 numerous times after use, such as polyester, nylon, spandex, cotton, parachute fabric, any combination thereof or any related material that is able to take on the general size and shape of the glove 10 and withstand the normal operating conditions of the glove 10. One skilled in the art will appreciate that the material of construction will not be limited to polyester, nylon, spandex, cotton, parachute fabric, or any combination thereof, but will also include any material suitable for withstanding the normal operating conditions of the illuminated glove 10. The illuminated glove 10 is also preferably constructed of a material capable of being dyed to any number of colors, but is not limited to such dye-able materials.

The palm portion 16 of the illuminated glove 10 preferably includes a padded material, such as foam, but is not so limited. Such padded material should be suitable for improving a wearer's comfort and providing padding or gripping for the palm portion 16. Some of the preferred embodiments of the glove 10 are constructed of the same material in the hand portion 12, the back portion 14 and the palm portion 16 or these portions may be constructed of different materials adapted for the various portions of the preferred illuminated glove 10. The hand portion 12 may be constructed of materials, such as, breathable polyester weave fabric, spandex dri-wicking fabrics, Neoprene, terry fabrics, suedes, faux suedes, quilting materials, Gore-Tex, fluoropolymer fabrics, vinyl, waterproof fabric, water resistant fabric, CarbonX fabrics, Nomex fabrics, fireproof or fire-resistant fabric, cotton, canvas, heavy canvas and related fabrics and materials that are able to take on or be assembled into the general size and shape of the glove 10 and withstand the normal operating conditions of the glove 10.

The illuminated glove 10 preferably contains a reflective portion, such as a reflective strip 11, to further aid in others' visibility of the wearer, but is not so limited. For example, the reflective strip 11 may be comprised of a reflective portion that is attached to the glove 10, such as by adhesive bonding or stitching, reflective materials incorporated into the materials of the glove 10, such as reflective or glowing dyes, or reflective components that are adhered or otherwise attached to the glove 10. In the first preferred embodiment, the reflective strip 11 is comprised of a reflective trim material that provides a border to the glove 10. The reflective strip 11 may alternatively be positioned on the palm portion 16 or nearly anywhere on the glove 10 to enhance safety for the wearer. For example, the reflective strip 11 of the first preferred embodiment may be attached to a wrist end 12*a* of the hand portion 12 and to a rear end of the housing 18. The reflective strip 11 is not limited to being connected to these listed portions of the glove 10 and may be connected or incorporated into nearly any portion of the glove 10 to provide reflection of light and added safety to a user or wearer.

The illuminated glove 10 also preferably includes finger portions 22 and a thumb portion 24. The finger portions 22 can be of any length, capable of covering only a small portion of the wearer's fingers, such as is shown in FIGS. 1-3, the wearer's fingers in their entirety, or any length in between. In the first preferred embodiment, the fingers 22 of the glove 10 extend approximately to the wearer's first knuckle or completely to the tip of the user's fingers, depending on user preferences. The thumb portions 24 can similarly be of any length. One skilled in the art will appreciate that the illuminated glove 10 can be constructed without the finger portions 22 and/or the thumb portion 24 that extend from the hand portion 12 without deviating from the inventive concept, such as by constructing the glove 10 as a mitten or constructing the glove 10 with holes to accommodate the user's fingers extending out of the glove 10. The glove 10 of the first preferred embodiment does not completely cover the tips of the users or runners fingers such that the user has the ability to touch and feel materials and objects that are grasped and providing at least some exposure for cooling of the fingers.

In the first preferred embodiment, a middle finger of the fingers 22 includes an elongated portion 22*x*. The elongated portion 22*x* is adapted for grasping by the user to facilitate removal of the glove 10 from the user's hand. The elongated portion 22*x* is shown extending from the back side of the glove 10 of the first preferred embodiment, but is not so limiting and may extend from the palm side of the glove 10 and may be associated with any of the fingers 22 or the glove 10 may include several elongated portions 22*x* on several of the fingers 22. The glove 10 is not limited to inclusion of the elongated portion 22*x* on the middle finger and may include the elongate portion on any of the other fingers 22, on the thumb 24 or may not include the elongated portion 22*x*. In addition, in full-fingered versions of the glove 10 (FIG. 2), the glove 10 preferably does not include the elongated portion 22*x*.

The fingers 22 are preferably constructed of the same breathable, soft, and flexible materials as any other portion of the illuminated glove 10, but are not so limited. Where the finger 22 are constructed of a sufficient length to cover the wearer's fingertips, the distal ends of the finger portions 22 are preferably also constructed of a conductive material 22*a* that enables the wearer to operate an electronic device, such as a smartphone, tablet, or portable music player, while wearing the illuminated glove 10, but are not so limited. The fingers 22 may be constructed of various materials, such as polar fleece, dri-wicking polyester blends, multiple knits, quilted fabrics or the like, but are not so limited and may be constructed of nearly any material that is able to be constructed into the general size and shape of the fingers 22 and can withstand the normal operating conditions of the glove 10.

The thumb 24 of the illuminated glove 10 is preferably constructed of a cotton terrycloth blend that may be utilized by the user to wipe and absorb sweat from the user's forehead or other areas, but is not so limited. One skilled in the art will appreciate that the thumb 24 is not limited to a cotton terrycloth blend, but may also be constructed of any material suitable for withstanding the normal operating conditions of the invention, such as cotton, polyester, nylon, and the like. The thumb 24 may also be constructed of the same breathable, soft, and flexible material as any other portion of the illuminated glove 10 and various material combinations may be used for the thumb 24 and fingers 22 based on designer or user preferences. The thumb 24 may also include the conductive material 24*a* proximate its tip that enables the user to operate electronic devices, such as smartphones, tablets or portable music players by interaction with a touch screen of these devices while wearing the illuminated glove 10, but are not so limited.

The illuminated glove 10 also preferably includes a second pocket 26 mounted proximate the palm portion 16 of the illuminated glove 10. The second pocket 26 is preferably configured to contain small items a runner or other user may find necessary to carry, such as a key, coins, energy packs, small food items, a battery recharging unit, a heat pack, or a replacement battery for the illuminated glove 10. The second pocket 26 is preferably constructed from the same breathable, soft, and flexible material as other portions of the illuminated glove 10, but can also be constructed of any material suitable for withstanding the normal operating conditions of the invention. One skilled in the art will appreciate that the illuminated glove 10 can be constructed without the second pocket 26 without deviating from the inventive concept.

The illuminated glove 10 preferably further includes a window 28 within the back portion 14. The window 28 is preferably located proximate the wrist end 12*a* so that he or she may see through the illuminated glove 10 to view his or her wristwatch, fitness tracker, or other wrist-mounted device without removing or shifting the illuminated glove 10. The window 28 is preferably plastic, polymeric material or vinyl, but can also be any transparent material suitable for withstanding the normal operating conditions of the illuminated glove 10. The window 28 is also preferably constructed in conjunction with an adjustable wrist band or strap 32 so that the wearer may adjust the size of the wrist opening of the illuminated glove 10 while ensuring the illuminated glove 10 is securely affixed to the wearer's hand. The wrist band 32 is preferably an elastic material and is preferably adjustable via a hook and loop material or Velcro strap, but is not so limited. One skilled in the art will appreciate that the wrist band 32 and window 28 may be constructed separately, or one or both may be omitted from the illuminated glove 10 entirely, without deviating from the inventive concept. The window 28 is also not limited to being located proximate the wrist end 12*a* and may be positioned nearly anywhere on the glove 10 for mounting of a fitness tracker, clock, stopwatch or other component or accessory that a user may desire to view while wearing the glove 10.

The housing 18 is preferably removable from the illuminated glove 10 for the purposes of laundering the illuminated glove 10, replacing the batteries (not shown) that power the light sources 20, and the like, but is not so limited. The housing 18 is preferably constructed of any weather-resistant material, such as a polymeric material, but is not so limited. The housing 18 may also be designed and configured to be fixed to the glove 10 so that the glove 10 is washable while the housing 18 is attached thereto.

Referring to FIGS. 1-7, the light sources 20 are preferably mounted within or to the housing 18 and are preferably comprised of approximately five (5) ultra-bright LEDs. One skilled in the art will appreciate that the light sources 20 are not necessarily comprised of LEDs and could be comprised of more or less than five (5) LEDs without deviating from the inventive concept, such as ten (10) LEDs. The LEDs may be comprised of surface mounted display ("SMD") variety LEDs or may be comprised of other varieties of LEDs or chip on board ("COB") SMDs.

The light sources 20 are preferably actuated by a switch 30 on a top of the housing 18, but are not so limited. For example, the light sources 20 may be associated with a sensor that senses ambient light and only illuminates the light sources 20 when the ambient light reaches a predetermined low level. In addition, the light sources 20 may be configured for illumination and/or powering only when the users/runners hands are heated to a predetermined temperature or otherwise reach to a predetermined parameter associated with the user or the user's environment. The switch 30 is preferably a pressure-sensitive button mounted on the housing 18 facing away from the glove 10 for access by the user. One skilled in the art will appreciate that the switch 30 can also be any type of switch suitable for actuating the light sources 20 and can also be mounted anywhere on the illuminated glove 10 suitable for withstanding the normal operating conditions of the preferred invention.

Figure 6:
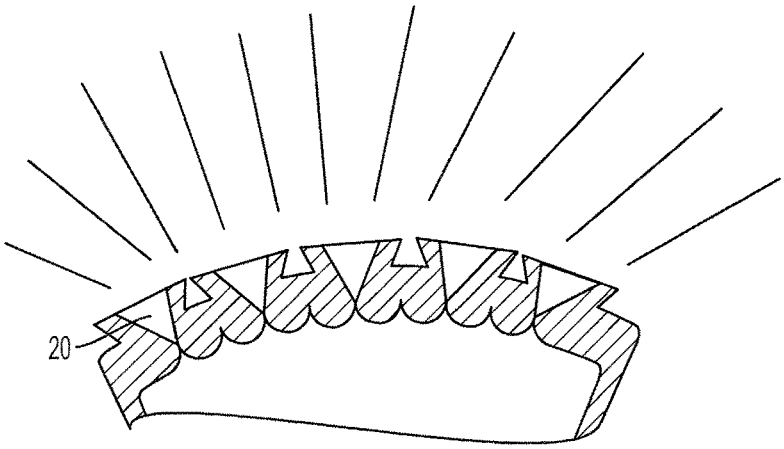
FIG. 6 is a top plan view of a second preferred lens of the illumination of FIG. 4A.
Figure 7:
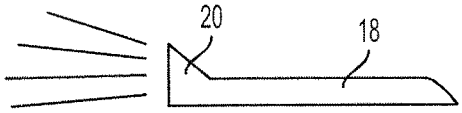
FIG. 7 is a side perspective view of the lens of FIG. 6.

As shown in FIGS. 4-7, the light sources 20 can be arranged in any number of configurations, such as in a parabolic arc (FIGS. 4A and 4B), extending from the housing (FIG. 5), or in a compact line (FIG. 6). One skilled in the art will appreciate that the light sources 20 are not limited to these arrangements and can be configured in many ways to achieve the desired objective. For example, the light sources 20 may have a similar shape to the knuckles of the wearer's hands to project light in nearly any direction in which the wearer directs their knuckles. The light sources 20 may also have an accordion-like shape that are adaptable by a user to direct the light emanating from the light sources 20 in a particular direction, to focus the light from the light sources 20 and/or to disburse the light emanating from the light sources 20. The light sources 20 may be adaptable to changed orientation, intensity, focus and power based on the desires of the user and/or designer. For example, the light sources 20 may be individually or collectively manipulated to direct a light stream sideways from the glove 20, generally outwardly and perpendicularly away from the glove 10, toward the wearer's fingers, toward the wearers arm or in nearly any direction desired by the wearer and/or the designer. Further, the light sources 20 may be designed such that each individual light may direct its light in nearly any desired direction or the plurality of light sources 20 may be arranged such that manipulation of one of the lights impacts the direction, intensity, focus, dispersion and the like of each of the lights 20. The lights 20 are also not limited to being comprised of lights and may be comprised of reflectors that reflect light that shines on the reflectors to alert others of the presence of the wearer of the glove 10.

As shown in FIG. 3, the palm portion 16 of the illuminated glove 10 also preferably includes an anchoring strap 34 useful for securing a personal protectant device such as mace or pepper spray. The anchoring strap 34 is preferably arranged on the palm portion 16 such that the personal protectant device is easily accessible in the event that the wearer encounters danger while exercising. In the first preferred embodiment, the glove 10 includes two individual anchoring straps 34 mounted to the palm portion 16 that facilitate securing of the personal protectant device or nearly any relatively small item in the user's palm. The user is preferably able to place the small item, such as the personal protectant device between the anchoring straps 34 and the palm portion 16 so secure the small item in the user's palm during use. In the first preferred embodiment, the anchoring straps 34 are constructed of an elastic material, but are not so limited and may be constructed of nearly any material or mechanism that is adaptable to securing a small item to the palm portion 16 and is able to withstand the normal operating conditions of the illuminated glove 10.

The preferred glove 10 may also include a controller (not shown) associated with the lights 20 that permits a user or automatically controls features of the lights, such as color, intensity, focus, blinking, sequenced illumination or like features. For example, the controller may permit a wearer to prompt intensity or blinking of the lights 20 or rapidly change colors of the lights 20 to draw attention in a perceived emergency situation, such as danger encountered on a remote running trail or on a night walk through a college campus. Such blinking or modification of the plurality of lights 20 provides a safety feature for the wearer to warn a potential attacker or safety personnel. Alternately, the controller may be operable to control an auditory alarm to draw attention by an audible siren or other audible warning.

The palm portion 16 of the first preferred glove 10 also preferably includes a third pocket 95 that may be utilized to receive an illumination data controller 160, 160', 160", 160''' as is described in greater detail below. The illumination data controller 160, 160', 160", 160''' can be selectively positioned in the third pocket 95 to illuminate the palm or inner portion of the user's fingers for low light illumination of this area and manipulation of items in the palm or with the user's fingers.

In addition, the controller may permit wireless communication with safety personnel as the result of the wearer activating transmission of a wireless signal from the controller to safety personnel. The strap 34 is not limited to affixing a personal protectant device, but may be used for storing any small item the wearer may wish to access while using the illuminated glove 10. The strap 34 is preferably a hook and loop material or Velcro strap, but is not so limited and may be constructed of any material suitable for withstanding the operating conditions of the invention, such as elastic and the like. One skilled in the art will appreciate that the strap 34 is not limited to a particular location on the palm portion 16, but may be arranged in any position on the illuminated glove 10 useful for affixing a small item without deviating from the inventive concept. In addition, the strap 34 may be comprised of a user actuatable pocket that is integrally formed with the glove 10 that may be actuated by the user when desired to perform a predetermined function, such as spraying mace, providing liquid hydration for the runner, providing an energy formula to the runner or for otherwise storing a material that may be accessed by the user during a desired situation.

The light sources 20 may be powered by any power source 36 suitable for powering the light sources 20. In the first preferred embodiment, the power source 36 is preferably comprised of a small battery 36 such as a button cell or a lithium cell battery 36, a 2032 coin cell battery, a lithium ion rechargeable battery or nearly any other variety of battery that is able to fit into the housing 18, with stand the normal operating conditions of the glove 10 and perform the functions of the battery. The power source 36 is preferably stored in the housing 18, but one skilled in the art will appreciate that the power source 36 may be arranged anywhere on the illuminated glove 10 without defeating the inventive concept. In an alternate embodiment, the power source 36 is a rechargeable battery linked to a solar cell (not shown) mounted on the illuminated glove 10 such that the solar cell is capable of recharging the power source 36, potentially when the user is wearing the glove 10. In addition, the power source 36 may be comprised of a conversion component or thermoelectric generator that converts heat generated by the wearer, such as the runner, into electrical power to illuminate the light sources 20 during use. The conversion component is not limited to converting heat generated by a runner and may use the heat generated by any wearer or user of the glove 10. The power source 36 is no limited to being comprised of the battery 36 or conversion component, but may also be comprised of a piezoelectric power source, an alternative solar power source or nearly any other variety of power source 36 that is designed and configured to provide power to the plurality of light sources 20 to illuminate the light sources 20. The power source 36 may also be comprised of multiple power sources, such as multiple batteries 36.

In yet another embodiment, the power source 36 may be comprised of a piezoelectric device which provides power to the light sources 20 via the vibrations and stresses created by the wearer's use of the glove 10 in activities such as running, bicycling, hiking, walking, working and the like. When configured as a piezoelectric device, the power source 36 is additionally capable of providing addition feedback to the wearer, conveying such information as distance run, time worn, the speed of the wearer's movement, and the like, through such methods as changing the color of the light sources 20, changing the blinking pattern of the light sources 20, providing a vibratory sensation, providing a display associated with a controller to display various performance features or other mechanisms to alert the user to predetermined performance characteristics.

Figure 8:
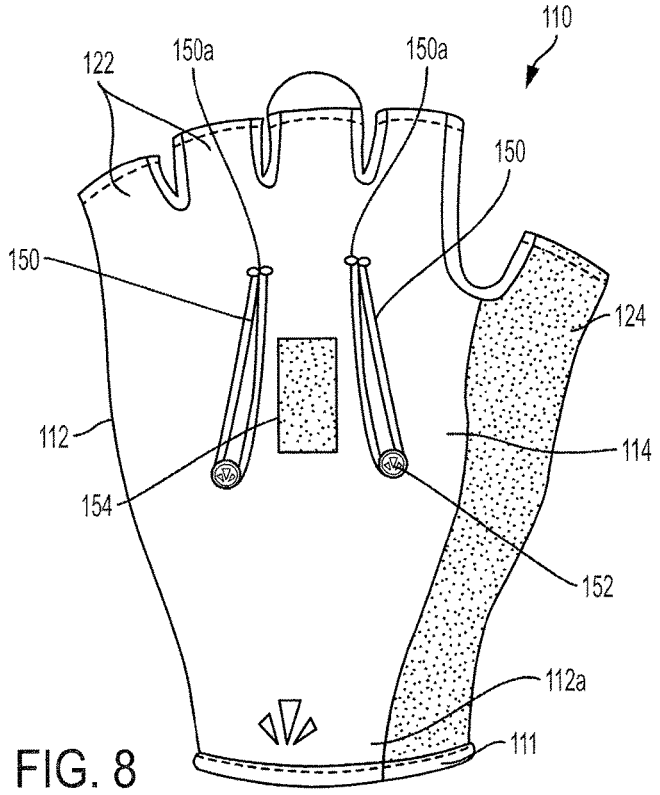
FIG. 8 is a top plan view of a glove in accordance with a second preferred embodiment of the present invention.
Figure 9:
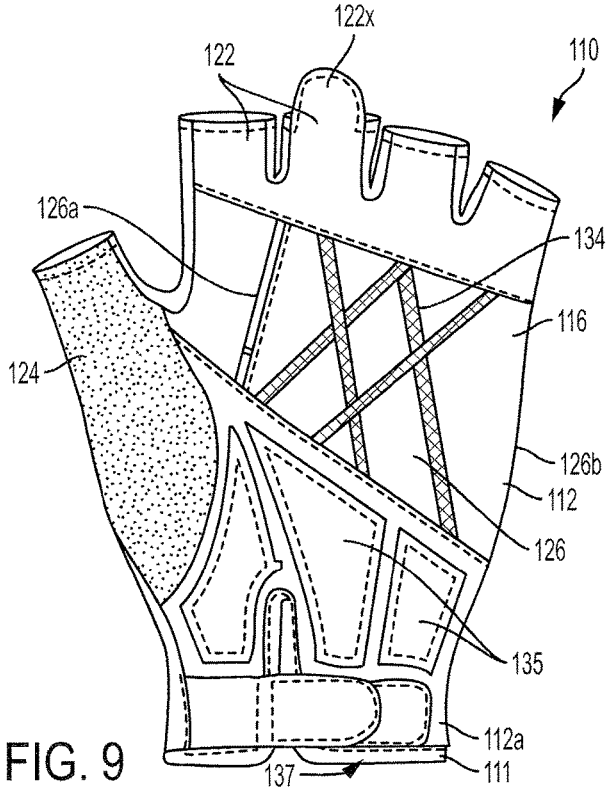
FIG. 9 is a bottom plan view of the glove of FIG. 8.

Referring to FIGS. 8 and 9, a second preferred embodiment of the glove 110 includes similar features and construction when compared to the first preferred embodiment of the glove 10. The same reference numerals are utilized to identify similar features of the second preferred embodiment when compared to the first preferred embodiment with a "1" prefix to distinguish the second preferred embodiment of the glove 110 from the first preferred embodiment of the glove 10.

Referring to FIGS. 8, 9, 12 and 13, the glove 110 of the second preferred embodiment includes a crisscross pattern of straps 134 on the palm portion 116 for securing a small item in the user's palm. The small item may be a personal protection device, key, key fob, card, credit card, currency, energy packs or nearly any other relatively small item, some additional items which were described above, that is able to fit into the users palm and between the palm portion 116 and the straps 134. The straps 134 may be constructed of or coated with a reflective material to act in a manner similar to the reflective strip 11. The glove 110 of the second preferred embodiment is not limited to inclusion of the straps 134 and may be constructed and configured without the straps 134 or may be constructed with an alternative securing mechanism for small items, such as a clamp, clip, hook and loop material, fastener, adhesive material or other small item securing mechanisms.

The palm portion 116 of the second preferred embodiment also preferably includes padded portions 135. The padded portions 135 provide padding in the palm portion 116 for user comfort and for gripping purposes. The palm portion 116 is not limited to inclusion of the padded portions 135 and may be constructed without the padded portions 135 or with padded portions 135 having a different size and configuration than the padded portions 135 shown in the second preferred embodiment.

In the second preferred embodiment, a wrist strap 137 is connected to the wrist end 112*a* of the glove 110. The wrist strap 137 is preferably comprised of a strap with hook and loop material that connects to complementary hook and loop material at the wrist end 112*a* to fasten and secure the glove 110 to the user's hand. The glove 110 is not limited to inclusion of the wrist strap 137 or the wrist strap 137 including hook and loop material. For example, the wrist strap 137 may be comprised of an elastic material that tightens around the user's wrist or includes alternative mechanisms or systems that assist in securing the glove 110 to the user's hand.

The glove 110 of the second preferred embodiment also preferably includes the second pocket 126 beneath the straps 134. The second pocket 126 preferably includes a second opening 126*a* proximate the thumb 124 and a second terminal end 126*b* proximate a side of the hand portion 112 opposite the thumb 124. The second opening 126*a* is preferably secured in a closed configuration with hook and loop material at the second opening 126*a* to secure small items within the second pocket 126. The second pocket 126 may include a battery recharging unit therein for recharging the battery of the light unit 18. The second pocket 126 is not limited to inclusion of the hook and loop material at the second opening 126*a* and may be otherwise configured to secure the second opening 126*a* in a closed configuration, such as a zipper, button and hole, adhesive material, fastener, clip or other securing mechanism that generally selectively closes the second opening 126*a* to secure the item therein an a closed configuration and allows the user to open the second opening 126*a* for removal of the item. Alternatively, the second opening 126*a* may be consistently left open without a securing mechanism, such as, if the material of the palm portion 116 and the second pocket 126 are configured to at least loosely secure the item therein, such as with relatively elastic material constructions of the glove 110. The second pocket 126 of the second preferred embodiment preferably extends to the terminal end 126*b* opposite the second opening 126*a* and, therefore, extends substantially across the palm portion 116. The second pocket 126 is not limited to having the depicted size and/or shape and may be smaller or larger depending on user or designers preferences.

The glove 110 of the second preferred embodiment also includes a pair of anchoring straps 150 mounted to the back portion 114 with corresponding hooks 152. The anchoring straps 150 are preferably fixed or secured at a first end 150*a* to the back portion 114 and form substantially endless loops that may be selectively connected to the hooks 152. A secondary securing mechanism 154 is also preferably positioned on the back portion 114 between the anchoring straps 150, but is not so limited and the glove 110 may function without inclusion of the secondary securing mechanism 154. The anchoring straps 150 are preferably constructed of an elastic or partially elastic material that may be stretched to engage the hooks 152 to apply tension to the anchoring straps 150 for securing nearly any item between the straps 150 and the back portion 114, such as keys, a key fob, personal protection device, writing instrument or nearly any other relatively small personal item. The secondary securing mechanism 154 is preferably a hook and loop material, but is not so limited and may be constructed of nearly any fastening or securing mechanism that is able to engage a light projecting mechanism, as is described in greater detail below.

Figure 12:
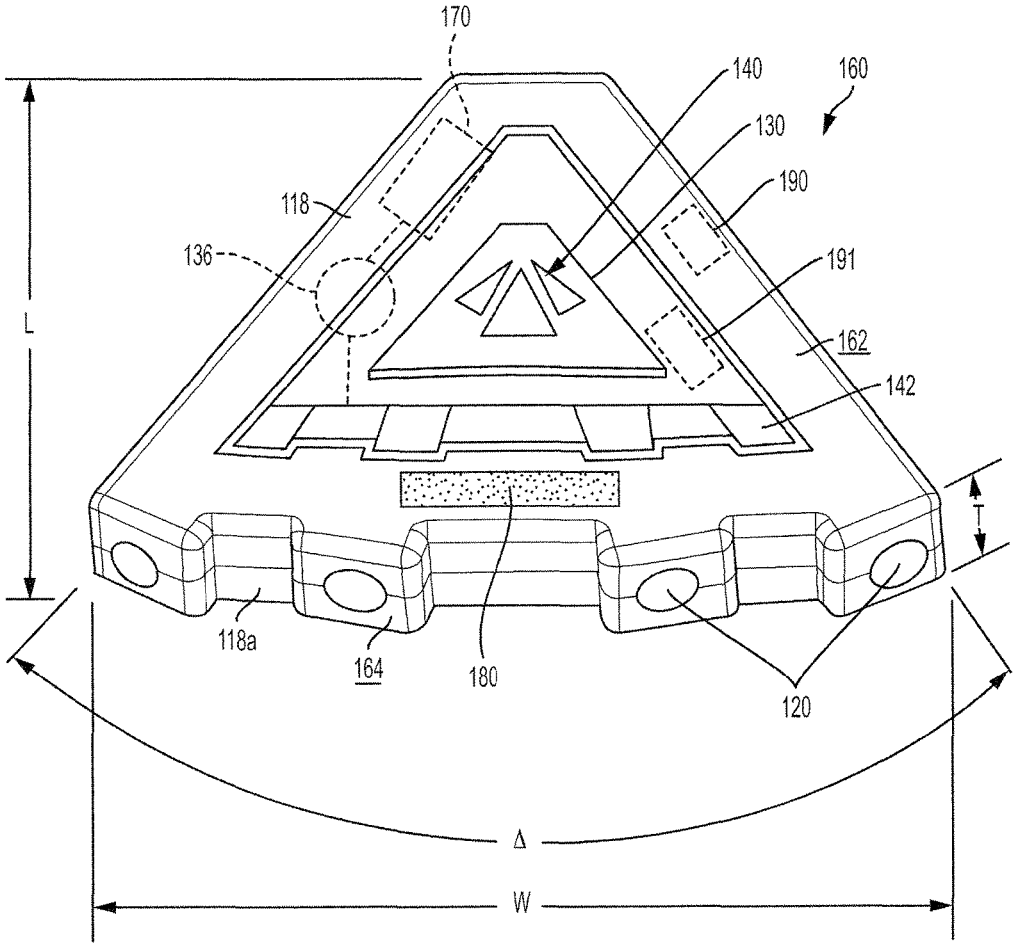
FIG. 12 is a front perspective view of an illumination data controller in accordance with a first preferred embodiment of the present invention that may be utilized with the any of the preferred gloves of the present invention.

In the second preferred embodiment, the anchoring straps 150 are particularly adapted for securing a preferred illumination data controller 160, 160', 160", 160'" to the glove 110. The illumination data controller 160, 160', 160", 160'" is configured to operate in the same or a similar manner to the housing 18 and light sources 20 of the glove 10 of the first preferred embodiment. The illumination data controller 160, 160', 160", 160'" includes a housing 118, 118', 118", 118'"

with a front face 118*a*, 118*a*', 118*a*", 118*a*'" a top surface 162, 162', 162", 162'", a length L, L', L", L'", a width W, W', W", W'" and a thickness T, T', T", T'". First and second preferred illumination data controllers 160, 160' are shown in FIGS. 12 and 13, with a prime symbol "'" being utilized to distinguish the illumination data controller 160 of the first preferred embodiment from the illumination data controller 160' of the second preferred embodiment, a third preferred illumination data controller 160" is shown in FIG. 10B with a double-prime symbol "'" utilized to distinguish the illumination data controller 160" of the third preferred embodiment and a fourth preferred illumination data controller 160'" is shown in FIG. 13C with a triple-prime symbol "'" utilized to distinguish the illumination data controller 160'" of the fourth preferred embodiment. The illumination data controllers 160, 160', 160'", 160'" are adapted for use with the preferred gloves 10, 110, 210, 402, 501, 601, 701, as is described herein and will be described in further detail below. The illumination data controllers 160, 160', 160", 160'" are preferably self-contained such that they do not include or require wires extending therefrom to power or control the units 160, 160', 160", 160'". The user is, therefore, able to generally move about freely with the preferred illuminated glove assemblies, as is described herein such that the preferred gloves 10, 110, 210, 402, 501, 601, 701 are generally hands-free for the user.

The first and second preferred embodiments of the illumination data controllers 160, 160' preferably include a front face 164, 164' from which light emanates from the light source 120, 120'. The light sources 120, 120' are preferably comprised of LED's, but are not so limited and may be comprised of nearly any source of light that is able to project light from the front face 164, 164' to illuminate an area in front of the front face 164, 164'. The front face 164, 164' and the light source 120, 120' may be configured to project light from the illumination data controllers 160, 160' over a variable angle, depending on user and designer preferences. For example, in the second preferred embodiment, the illumination data controller 160' is configured to project light from the front face 164' over an arc Δ' of at least two hundred thirty-five degrees) (235°, while the front face 164 of the first preferred embodiment of the illumination data controller 160 is configured to project light over an arc of slightly more than ninety degrees) (90°. The arc Δ, Δ' of lateral light projection from the front faces 164, 164' is not limited to these described configurations and may be arranged and configured to laterally project light over alternative ranges, as desired by the user or designer and may also be configured to change the arc Δ, Δ' dynamically via controls in or on the housing 18, 118, 118' to widen, focus, alter or otherwise change the orientation of the light emanating from the light sources 120, 120'. The first preferred illumination data controller 160 includes four (4) light sources 120, preferably LEDs, and the second preferred illumination data controller 160' includes six (6) light sources 120', preferably LEDs, but the illumination data controllers 160, 160' are not limited to the specifically shown number of lights sources 120, 120' and may have alternate numbers of LEDs or may be otherwise configured with alternative lighting mechanisms.

Referring to FIGS. 8 and 12-13B, both of the illumination data controllers 160, 160' of the first and second preferred embodiments are adapted for selective mounting to the back portion 114 of the glove 110 of the second preferred embodiment. The illumination data controllers 160, 160' are preferably attached to the secondary securing mechanism 154 of the glove 110 through the lower securing mechanism 166'. The light anchoring straps 150, 150' are wrapped over the top surface 162, 162' of the illumination data controller 160, 160' and the ends are secured to the hooks 152. The illumination data controllers 160, 160' are arranged with the front faces 164, 164' positioned proximate the fingers 122 such that the light extends outwardly and away from the user knuckles during use. A middle finger 122 of the fingers preferably includes an elongated portion 122*x* extending away from the fingers 122 on the palm side of the glove 110. The elongated portion 122*x* is preferably grasped by the user to assist in removing the glove 110 from the user's hand. The elongated portion 122*x* is not limited to being included on the middle finger 122 and may be included on any of the other fingers 122 or on multiple of the fingers 122. The light is preferably activated by depressing a control button or switch 130, 130' on the top surface 162, 162'. The illumination data controller 160, 160' is preferably, thereby held on the glove 110 during activity.

Following the activity or generally to remove the illumination data controllers 160, 160' from the glove 110, the anchoring straps 150, 150' are detached from the hooks 152 and the secondary securing mechanism 154 is removed from the lower securing mechanism 166'. A different illumination data controller may then be likewise mounted to the glove 110, the battery 36 may be replaced, the glove 110 may be washed or other similar actions may be taken.

In the first preferred embodiment, the illumination data controller 160 includes a solar panel or solar cell 142 on its top surface 162. The solar panel 142 is preferably able to collect solar energy for charging or re-charging the battery 136. The solar panel 142 may be comprised of a crystalline solar panel 142 or nearly any solar panel or array that is able to collect solar energy and convert the solar energy to electrical energy to power the illumination data controller 160.

Figure 10A:
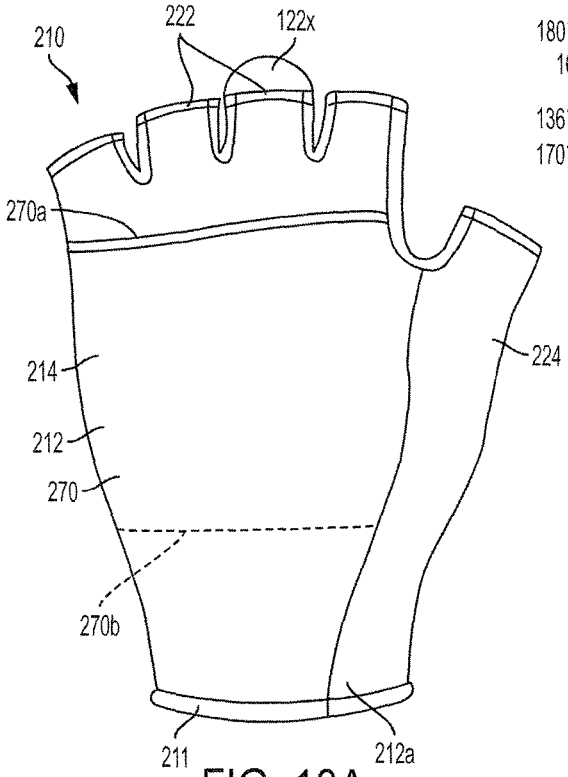
FIG. 10A is a top plan view of a glove in accordance with a third preferred embodiment of the present invention that may be utilized with any of the preferred gloves of the present invention.
Figure 10B:
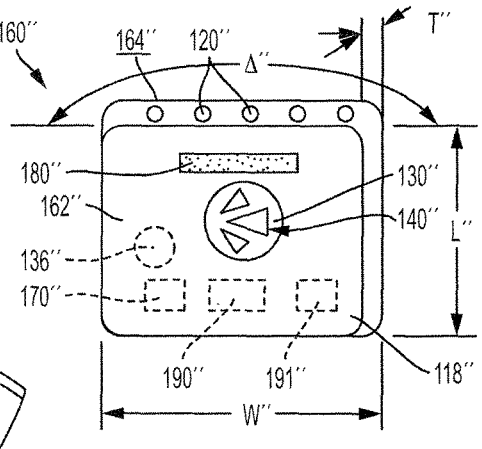
FIG. 10B is a top perspective view of an illumination data controller in accordance with a third preferred embodiment of the present invention.
Figure 11:
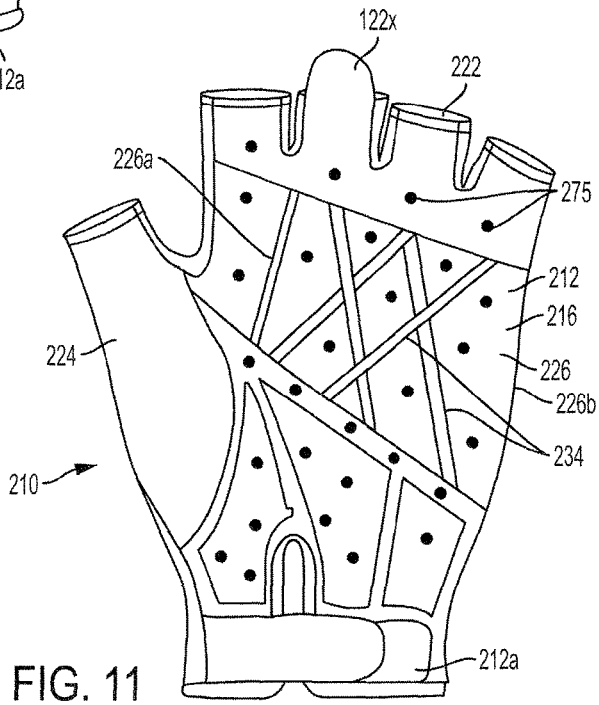
FIG. 11 is a bottom plan view of the glove of FIG. 10.

Referring to FIGS. 10A-11, a third preferred embodiment of the glove 210 includes similar features and construction when compared to the first and second preferred embodiments of the glove 10, 110. The same reference numerals are utilized to identify similar features of the third preferred embodiment when compared to the first and second preferred embodiments with a "2" prefix to distinguish the third preferred embodiment of the glove 210 from the first and second preferred embodiments of the glove 10, 110.

The third preferred embodiment of the glove 210 is also adapted for use with a third preferred embodiment of the illumination data controller 160", but may also be utilized with the first and second preferred illumination data controllers 160, 160'. The third preferred embodiment of the illumination data controller 160" includes similar features and construction when compared to the first and second preferred embodiments of the illumination data controller 160, 160'. The same reference numerals are utilized to identify similar features of the third preferred embodiment when compared to the first and second preferred embodiments with a double-prime "'" symbol utilized to distinguish the third preferred embodiment of the illumination data controller 160" from the first and second preferred embodiments of the illumination data controller 160, 160'.

The glove 210 of the third preferred embodiment includes a first pocket 270 in the back portion 214. The first pocket 270 includes a first opening 270*a* proximate the fingers 222 and a first terminal end 270*b* proximate the wrist end 212*a*. The first pocket 270 is preferably formed between the first opening 270*a* and the first terminal end 270*b* between portions of fabric of the back portion 214, but is not so limited and may be otherwise formed by separate material from the glove 210 or otherwise, as long as a first pocket 270 is formed and attached to the glove 210 for receipt of one of the illumination data controllers 160, 160', 160". In addition, the first pocket 270 is not limited to being positioned on the back portion 214 and may be alternatively mounted on the palm portion 216 for receipt of the illumination data controllers 160, 160', 160" to project light onto the inner-fingertips of the user or wearer. Illuminating the fingertips of the user may be desirable for users performing relatively fine tasks proximate the fingertips, such as a fisherman threading fishing line into the eye of a fishing hook in dark or low light conditions.

The first opening 270*a* is preferably selectively opened and closed utilizing hook and loop material positioned along the internal edge of the first opening 270*a*, but is not so limited. The first opening 270*a* may be otherwise selectively opened or closed using a zipper, clamp, button and hole, adhesive material or other selective fastening or securing device that is able to substantially secure the illumination data controllers 160, 160', 160" in the first pocket 270*a*, as is described in further detail below. The first opening 270*a* is also not limited to inclusion of a securing device or mechanism and may be constructed of a constantly open first opening 270*a* with only the material of the glove 10 forming the first opening 270*a*, preferably with the material having elasticity to hold the illumination data controllers 160, 160', 160" within the first pocket 270. The first opening 270*a* may be utilized for inserting items for storage within the first pocket 270.

In the preferred embodiments, the hook and loop material at the first opening 270*a* interacts with an engagement mechanism 180, 180', 180" on the top surfaces 162, 162', 162" and bottom surfaces 163' of the illumination data controllers 160, 160', 160" to assist with securing the illumination data controllers 160, 160', 160" in the first pocket 270. The illumination data controllers 160, 160', 160" may be secured in the first pocket 270 with the light sources 120, 120', 120" oriented at different angles relative to the user's hand and the first opening 270*a*, for example, such that the light sources 120, 120', 120" may be directed over the user's thumb to a direction over the user's pinky. The bottom surfaces 163' may be constructed of a resilient material or have a resilient material, such as silicone, coated thereon to improve comfort for the user. The rear portion of the housings 118, 118', 118" are preferably slid into the first pocket 270 at least until the engagement mechanism 180, 180', 180" contacts and is secured to the hook and loop material at the first opening 270*a* with the light sources 120, 120', 120" positioned outside of the first pocket 270. This mounted configuration assists in securing the illumination data controllers 160, 160', 160" to the glove 210 and positions the lights sources 120, 120', 120" to direct light over the user's knuckles. The illumination data controllers 160, 160', 160" are not limited to having the engagement mechanism 180, 180', 180", to hook and loop material or to the specific placement of the engagement mechanism 180, 180', 180", but the glove 210 preferably includes accommodation of some feature that orients the light sources 120, 120', 120" relative to the glove 210 and secures the engagement mechanism 180, 180', 180" to the glove 210. The engagement mechanism 180, 180', 180" is not limited to being comprised of hook and loop material and may be comprised of any connector that releasably secured the illumination data controller 160, 160', 160" in the pockets 270, 403, 508, 608, 708, some of which are described in greater detail below. The connector comprising the engagement mechanism 180, 180', 180" may include magnets, fasteners, clamps, adhesive or other mechanisms or methods that are able to releasably secure the illumination data controller 160, 160', 160" in the pockets 270, 403, 508, 608, 708.

In the preferred embodiments, the length L, L', L", L'" and width W, W', W", W'" of the illumination data controllers 160, 160', 160", 160'" are measured at the maximum length and width of the preferred illumination data controllers 160, 160', 160", 160'". The width W, W', W", W'" of the preferred embodiments is greater than the length L, L', L", L'", which is in turn greater than the thickness T, T', T", T'". Such a design of the preferred illumination data controllers 160, 160', 160", 160'" results in a relatively compact, low-profile design and generally maximizes the front face 164, 164', 164", 164'" for significant illumination across and beyond the user's knuckles. The illumination data controllers 160, 160', 160", 160'" are not so limited and may be otherwise designed and configured based on user and designer desires or for particular varieties of design considerations.

Referring to FIG. 10B, in the third preferred embodiment, the illumination data controller 160" has a width W" of approximately one and three-quarters (1¾"), a length of one and one-half inches (1½") and a thickness of one-half inch (½"). The illumination data controller 160" is not limited to these preferred dimensions and may be otherwise sized and configured for mounting to the gloves 10, 110, 210, for projecting a preferred amount of light from the front face 164, 164', 164' and for otherwise performing the preferred functions of the illumination data controller 160". The other preferred illumination data controllers 160, 160', 160'" may be sized and configured similarly to or the same as the third preferred illumination data controller 160".

Figure 13B:
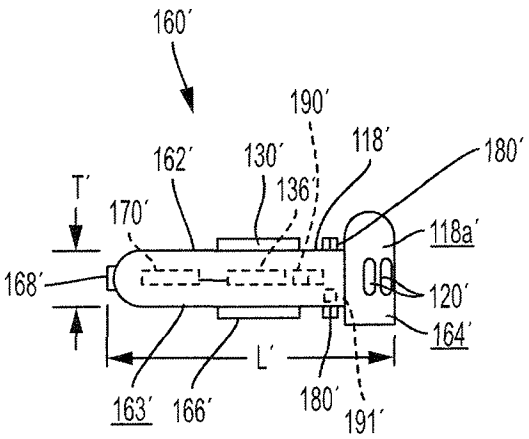
FIG. 13B is a side elevational view of the illumination data controller of FIG. 13A.
Figure 13A:
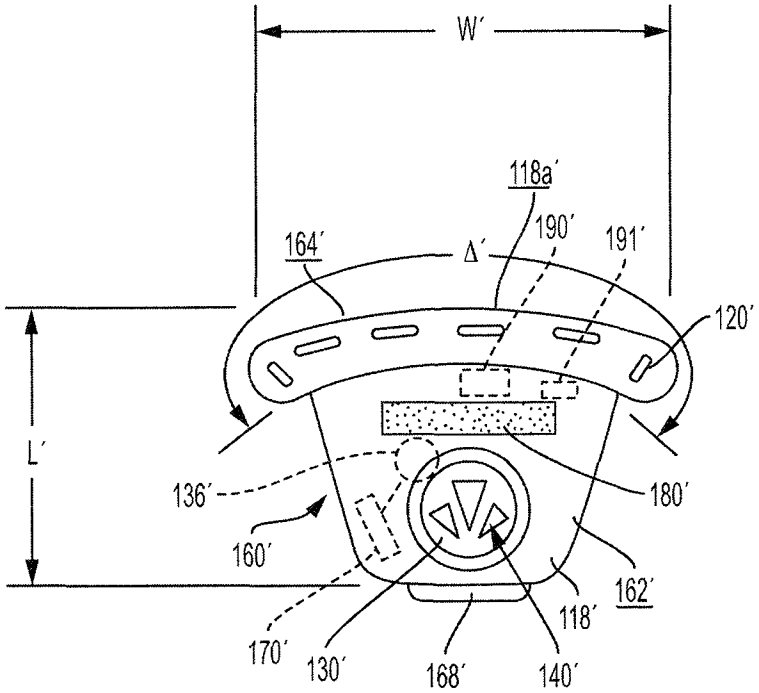
FIG. 13A is a top plan view of an illumination data controller in accordance with a second preferred embodiment of the present invention that may be utilized with any of the preferred gloves of the present invention.
Figure 13C:
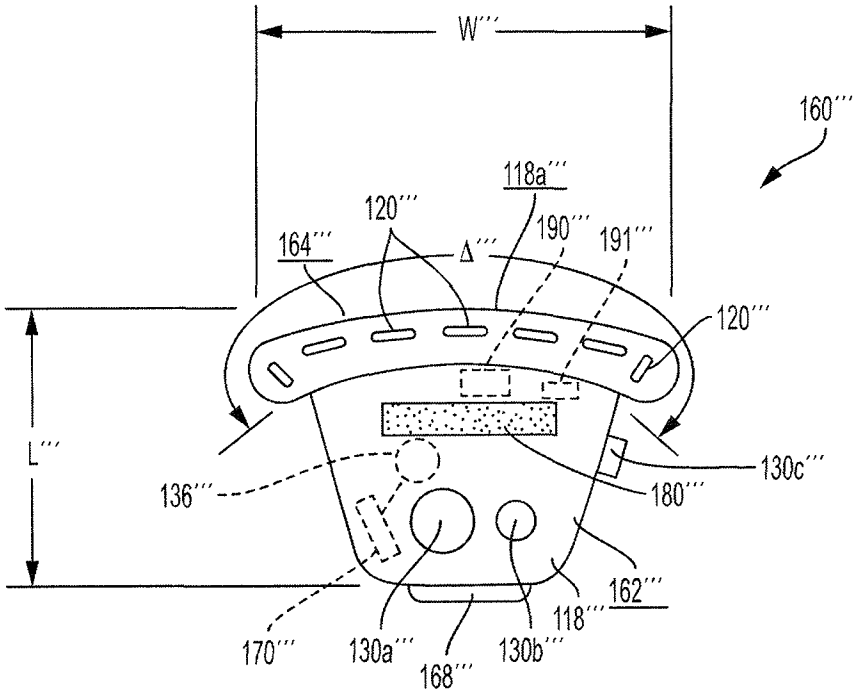
FIG. 13C is a top plan view of an illumination data controller in accordance with a fourth preferred embodiment of the present invention that may be utilized with any of the preferred gloves of the present invention.

Referring to FIGS. 13A and 13B, in the second preferred embodiment of the illumination data controller 160', an electrical connection port 168' is positioned at a rear of the housing 118'. The electrical connection port 168' may be utilized for recharging the battery 36, to load information into a processor for programming functions related to the illumination data controllers 120', for collecting data sensed by sensors in the housing 118' or for other connection purposes. The electrical connection port 168' may be comprised of a universal serial bus ("USB") port or other connection port for communication with the illumination data controller 160' and its features and components. The illumination data controller 160' of the second preferred embodiment is not limited to inclusion of the electrical connection port 168' or to inclusion of only one electrical connection port 168' and may include none or multiple electrical connection ports 168'. In addition, the first and third preferred illumination data controllers 160, 160" may likewise include none or more than one electrical connection port 168'.

The preferred illumination data controllers 160, 160', 160", 160'" include a wireless transmitter 170, 170', 170", 170'" mounted within the housing 118, 118', 118", 118'" that is configured for communication with other wireless receivers and transmitters (not shown) to send and receive data. The preferred illumination data controllers 160, 160', 160", 160'" also preferably include alarms and safety features for the wearer or user. The wireless transmitters 170, 170', 170", 170'" are preferably powered by the batteries 136, 136', 136", 136'" and may transmit and receive various types and varieties of data to other wireless transmitters and receivers. For example, the wireless transmitter 170, 170', 170", 170'" may send an emergency message and location information when prompted by the wearer to alert emergency personnel to enhance the user's safety. The wireless transmitter 170, 170', 170", 170'" may also transmit location information and receive direction information for a runner that pre-determines a running route and the illumination data controller 160, 160', 160", 160'" may audibly or visually provide direction information to the wearer to follow the predetermined route. The wireless transmitter 170, 170', 170", 170'" may also transmit information collected from sensors associated with the transmitter 170, 170', 170", 170'" or glove 10, 110, 210, 402, 501, 601, 701 related to physiological properties of the user for performance or health and safety purposes.

In the preferred embodiments, the illumination data controllers 160, 160', 160", 160'" include a circuit board 190, 190', 190", 190'" and a microchip 191, 191', 191", 191'" in communication with the light source 120, 120', 120", 120'". The circuit board 190, 190', 190", 190'" and the microchip 191, 191', 191", 191'" are preferably configured to control operation of the light sources 120, 120', 120", 120'" such as to display a blinking or predetermined light show from the light sources 120, 120', 120", 120'". The information for the predetermined light shows or other control related to the circuit board 190, 190', 190", 190'" and the microchip 191, 191', 191", 191'" may be pre-loaded into the illumination data controllers 160, 160', 160", 160'" may be sent via the wireless transmitters 170, 170', 170", 170'" or may be otherwise communicated, such as through wired communication through the electrical connection port 168'.

In operation, the user may place the glove 10, 110, 210, 402, 501, 601, 701 onto their hand with the illumination data controllers 160, 160', 160", 160'" already connected thereto or may engage the illumination data controller 160, 160', 160", 160'" with the glove 10, 110, 210, 402, 501, 601, 701 after placement on their hand. The preferred illumination data controller 160, 160', 160", 160'" is urged into the first pocket 270, 403, 507, 607, 707 through the first opening 270*a* at least until the engagement mechanism 180, 180', 180", 180'" contacts and engages the hook and loop material or other securing mechanism at the first opening 270*a* or the illumination data controller 160, 160', 160", 160'" is fully seated in the pocket 270, 403, 507, 607, 707. The user may then actuate the light sources 120, 120', 120", 120'" by depressing the control button or switch 130, 130', 130". The user may also position relatively small items beneath the straps 234 and in the second pocket 226 on the palm portion 216. The second pocket 226 may include a recharging unit therein that is able to recharge the light sources 120, 120', 120", 120'" by connecting a lead wire between the recharging unit and the light sources light sources 120, 120', 120", 120'" or otherwise electrically connecting the recharging unit and the light sources light sources 120, 120', 120", 120'" for recharging purposes.

The palm portion 216 of the third preferred glove 210 includes gripping dots 275 thereon to facilitate gripping or grasping of items that are positioned in the user's palm. The circuit board 190, 190', 190", 190'" and the microchip 191, 191', 191", 191'" may be comprised of a chip mounted on board-variety unit that is located in the housing 118, 118', 118", 118'" below the control button 130, 130', 130". The control button 130, 130', 130" preferably includes a symbol 140 thereon comprised of three triangles pointing in a predetermined direction. A corresponding symbol may be located on the glove 10, 110, 210, 402, 501, 601, 701 to indicate to the user the authenticity of the pairing of the glove 10, 110, 210, 402, 501, 601, 701 and the illumination data controller 160, 160', 160", 160'" or the expected direction for mounting the illumination data controller 160, 160', 160", 160'" on the glove 10, 110, 210, 402, 501, 601, 701. The symbol 140 may be illuminated for user convenience or to indicate the power level or charge of the power source or battery 36, 136, 136', 136", 136'". The symbol 140 may further indicate a power level of the light sources 120, 120', 120", 120'" of the illumination data controller 160, 160', 160", 160'" the provides high power for significant illumination and lower powers for lighter, more subtle light projection. The symbol 140 may also be comprised of a light channel for presenting notifications to the user or wearer. The battery 36, 136, 136', 136", 136'" may also remain mounted or secured to the preferred gloves 10, 110, 210, 402, 501, 601, 701, 801.

Referring to FIG. 13C, a fourth preferred embodiment of an illumination data controller 160'" includes similar features and construction when compared to the first, second and third preferred embodiments of the illumination data controller 160, 160', 160". The same reference numerals are utilized to identify similar features of the fourth preferred embodiment of the illumination data controller 160'" when compared to the first, second and third preferred embodiments with a triple-prime "'" symbol utilized to distinguish the fourth preferred embodiment of the illumination data controller 160'" from the first, second and third preferred embodiments of the illumination data controller 160, 160', 160". For example, the illumination data controller 160'" includes the housing 118'" with the front face 118*a*'", the light sources 120'", the battery 136'", the top surface 162'", the front face 164'", the electrical connection port 168'", the wireless transmitter 170'", the engagement mechanism 180'", the circuit board 190'", the microchip 191'", the length L'", the width W'" and the light arc Δ'". The fourth preferred illumination data controller 160'" also includes seven (7) light sources 120'" along its front face 164'" to project light, but is not so limited and may include six (6) light sources 120' similar to the second preferred embodiment, five (5) light sources 120" similar to the third preferred embodiment, four (4) light sources 120 similar to the first preferred embodiment or more or less light sources, depending on user and designer preferences.

The fourth preferred illumination data controller 160'" includes the light arc Δ'" to project light from the front face 164'" over at least two hundred thirty-five degrees (235°) such that the user has a relatively wide arc of light projection for illumination purposes. The light sources 120'" of the fourth preferred illumination data controller 160'" are actuated by first, second and third control buttons or switches 130*a*'", 130*b*'", 130*c*'". The first, second and third control buttons or switches 130*a*'", 130*b*'", 130*c*'" preferably actuate the circuit board 190'" and the microchip 191'" to control the light sources 120'". In the fourth preferred embodiment, the first control button 130*a*'" turns the light sources 120'" off and on, the second control button 130*b*'" controls the color of the light emanating from the light sources 120'", such as white, green, red or blue, and/or the flashing or sequenced illumination of the light sources 120'" and the third control button 130*c*'" functions as an alarm to sound an audible alarm sound and/or to cause an alarming flashing of the light sources 120'". For example, when the third control button 130*c*'" is depressed, the circuit board 190'" and the microchip 191'" may prompt an audible alarm to sound and prompt the light sources 120'" to flash through a sequence of red, white and blue colors or nearly any other flashing color combination, such as flashing red. The circuit board 190'" and microchip 191'" may also actuate the wireless transmitter 170'" to send an alarm or warning signal to an authority, such as a "911" operator including the illumination light unit's 160'" location.

Figure 14A:
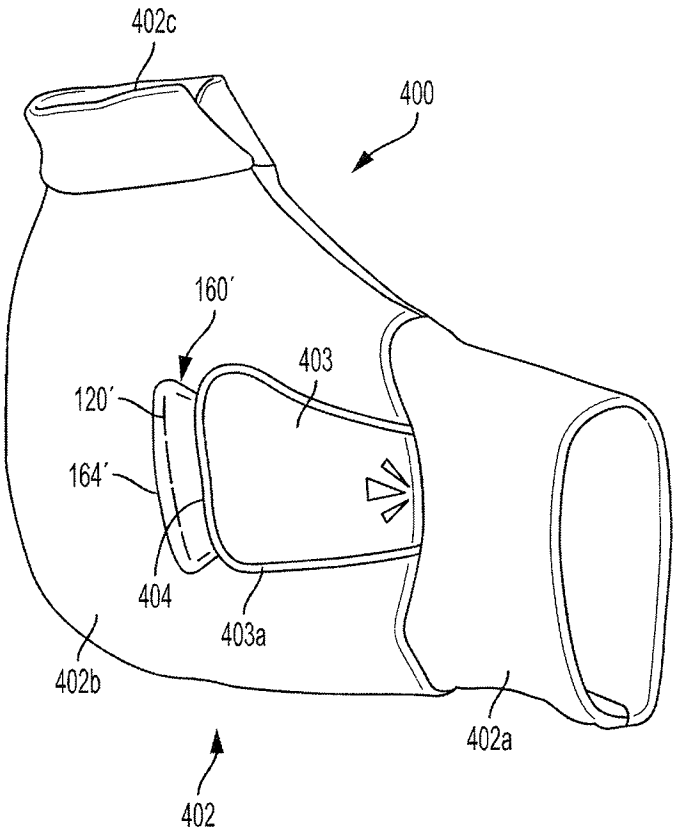
FIG. 14A is a top perspective view of an illuminated glove assembly in accordance with a fourth preferred embodiment of the present invention, including a rower glove with the second preferred illumination data controller of FIG. 13A mounted therein.
Figure 14B:
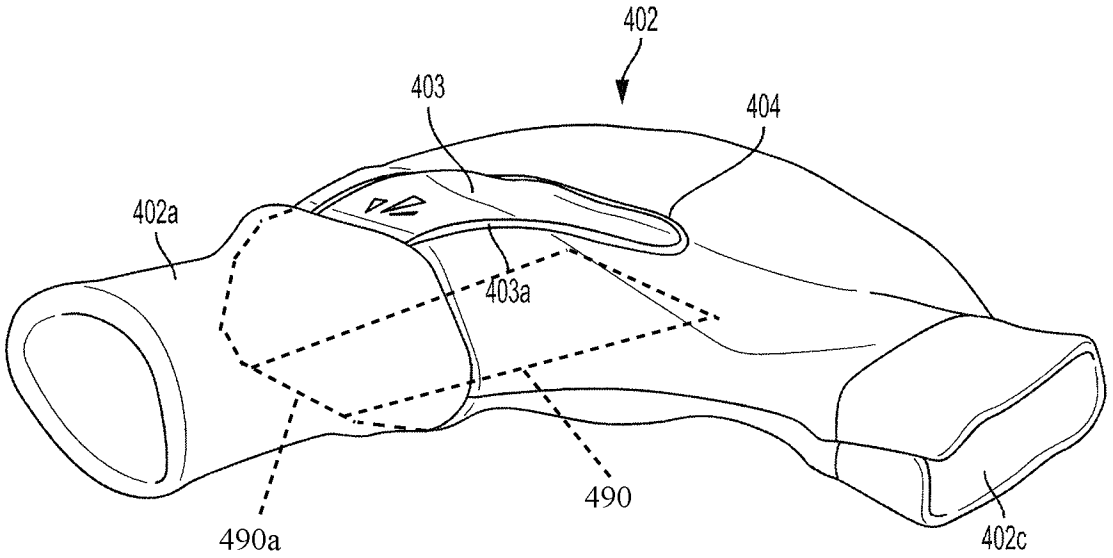
FIG. 14B is a side perspective view of the illuminated glove assembly of FIG. 14A.

Referring to FIGS. 14A and 14B, an illuminated glove assembly 400 in accordance with a fourth preferred embodiment of the present invention includes a rower glove 402 and the illuminated light unit 160' mounted therein. The fourth preferred illuminated glove assembly 400 is not limited to including the second preferred illuminated light unit 160' mounted therein and may include any of the preferred illuminated light units 160, 160', 160", 160''' mounted thereto or other light units that are adapted for use with the preferred rower glove 402. The preferred rower glove 402 includes a mitten portion 402*b* with a side hole 402*c* and a wrist portion 402*a*.

The mitten portion 402*b* of the rower glove 402 is preferably constructed of a fleece or other insulating fabric material and the wrist portion 402*a* is preferably constructed of an elastic material. The rower glove 402 is open or hollow within the mitten portion 402*b* such that the user's fingers are free to move therein. The side hole 402*c* is preferably configured and sized to accept the end of an oar or paddle into the inner portion or hollow of the mitten portion 402*b* for grasping by the user. Insertion of the end of the oar or paddle through the side hole 402*c* provides warmth for the rower's hand, but direct contact of the rower's hand with the oar or paddle. The rower glove 402 is not limited to having only the side hole 402*c* positioned proximate the user's thumb and may include a second side hole (not shown) extending through an opposite side of the rower glove 402 near the pinky of the user's hand. The second side hole permits the handle of the oar or paddle to extend through the rower glove 402, particularly on an inboard hand of the rower so that the rower can grasp the handle with both hands. In addition, the second side hole permits the user to insert the shaft of the oar from either side. Rowers often practice or compete in early morning hours in cold environments in or on the water and the rower glove 402 provides warmth for the rower's hand, but direct grasping of the end of the oar or paddle without material between the rower's hand and the oar or paddle.

The mitten portion 402*b* of the rower glove 402 also preferably includes a pocket portion 403 secured to a top of the mitten portion 402*b* or to a side of the mitten portion 402*b* opposite the user's palm when the rower glove 402 is on the user's hand. The pocket portion 403 of the fourth preferred embodiment is stitched to the mitten portion 402*b* along side edges and a rear edge of the pocket portion 403. The pocket portion 403 includes a light unit opening 404 at a front side configured for receipt and mounting of any one of the preferred illumination light units 160, 160', 160", 160''' therein in a manner similar to the above-described first pocket 270 of the glove 210 of the third preferred embodiment. The preferred illumination light units 160, 160', 160", 160''' may be positioned in the pocket portion 403 with the light sources 120, 120', 120", 120''' exposed outside of the pocket portion 403 to provide light for the user, such as a rower. As described above, rowers often practice or compete in early morning or late night hours when natural light is limited and near bodies of water, such that the light from the illumination light units 160, 160', 160", 160''' improve safety for the users and rowers when moving around in dark environments and when utilizing rowing equipment, such as paddles, boats, sculls and oars, in proximity to teammates and other rowers. The pocket portion 403 stitched to the mitten portion 402*b* is not limiting for securing the illumination light units 160, 160', 160", 160''' to the rower glove 402 and light may be provided with the rower glove 402 or the illumination units 160, 160', 160", 160''' may be engaged to the rower glove 402 in alternative manners, such as the features and methods of the above-described preferred gloves 10, 110, 210, 501, 601, 701 or other alternative features or methods.

The pocket portion 403 of the fourth preferred embodiment includes a peripheral edge 403*a* proximate to which the pocket portion 403 is stitched to the mitten portion 402*b*. A front and sides of the peripheral edge 403*a* include a reflective material mounted thereto that provides a reflective safety feature for the rower that reflects light. The rower glove 402 is not limited to including the reflective material at its peripheral edge 403*a* and may be constructed without the reflective material. The reflective material also assists the user in locating and identifying the light unit opening 404 for insertion of one of the illumination light units 160, 160', 160", 160''' therein. The preferred rowers glove 402 does not include the reflective material at the peripheral edge 403*a* where the pocket portion 403 meets the wrist portion 402*a*, but is not so limiting and may include reflective material along this portion of the peripheral edge 403*a* and may include reflective material along an entire connection of the wrist portion 402*a* with the mitten portion 402*b*.

Figure 15:
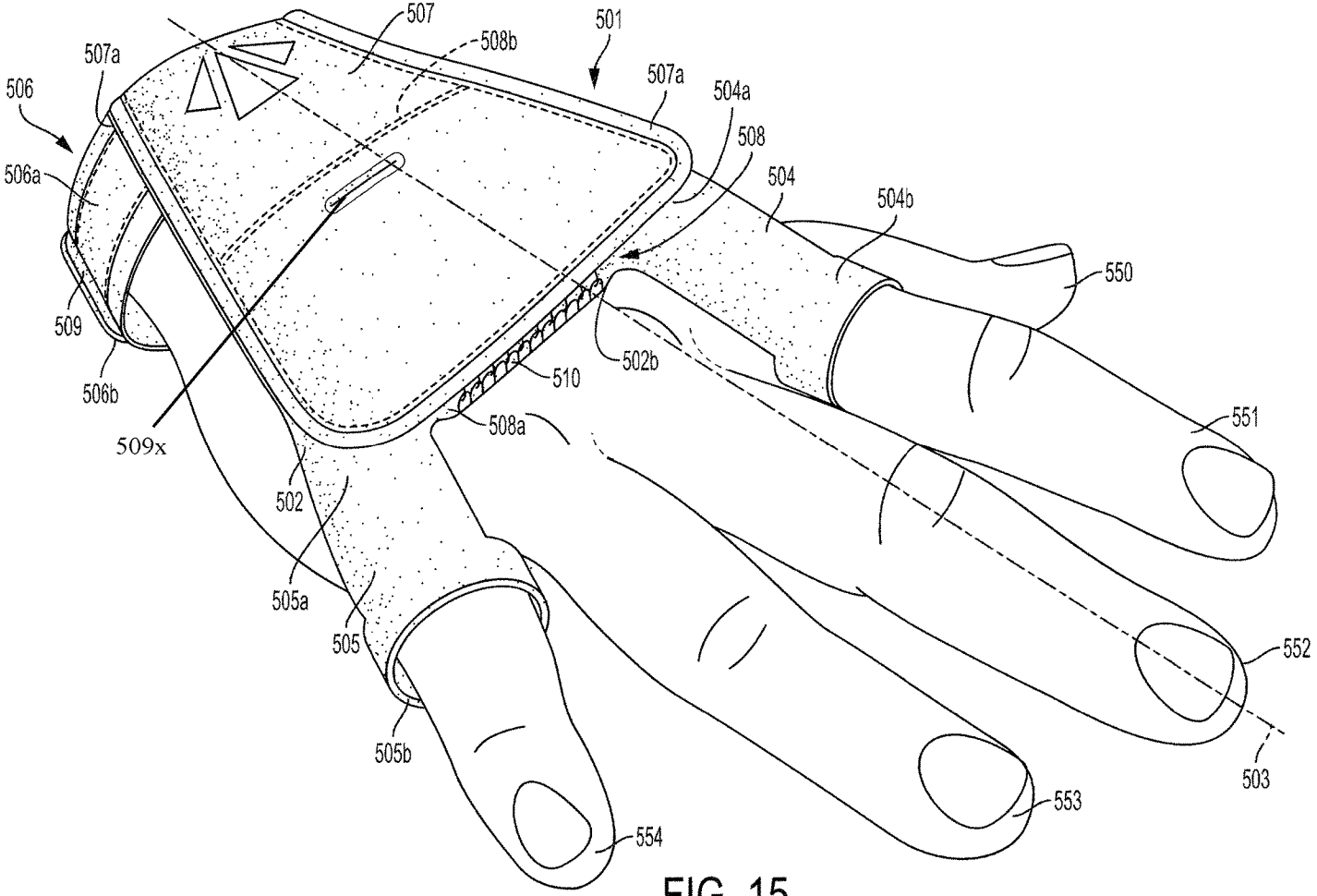
FIG. 15 is a top perspective view of a glove for an illuminated glove assembly in accordance with a fifth preferred embodiment of the present invention, wherein the glove is positioned on a user's hand.
Figure 16:
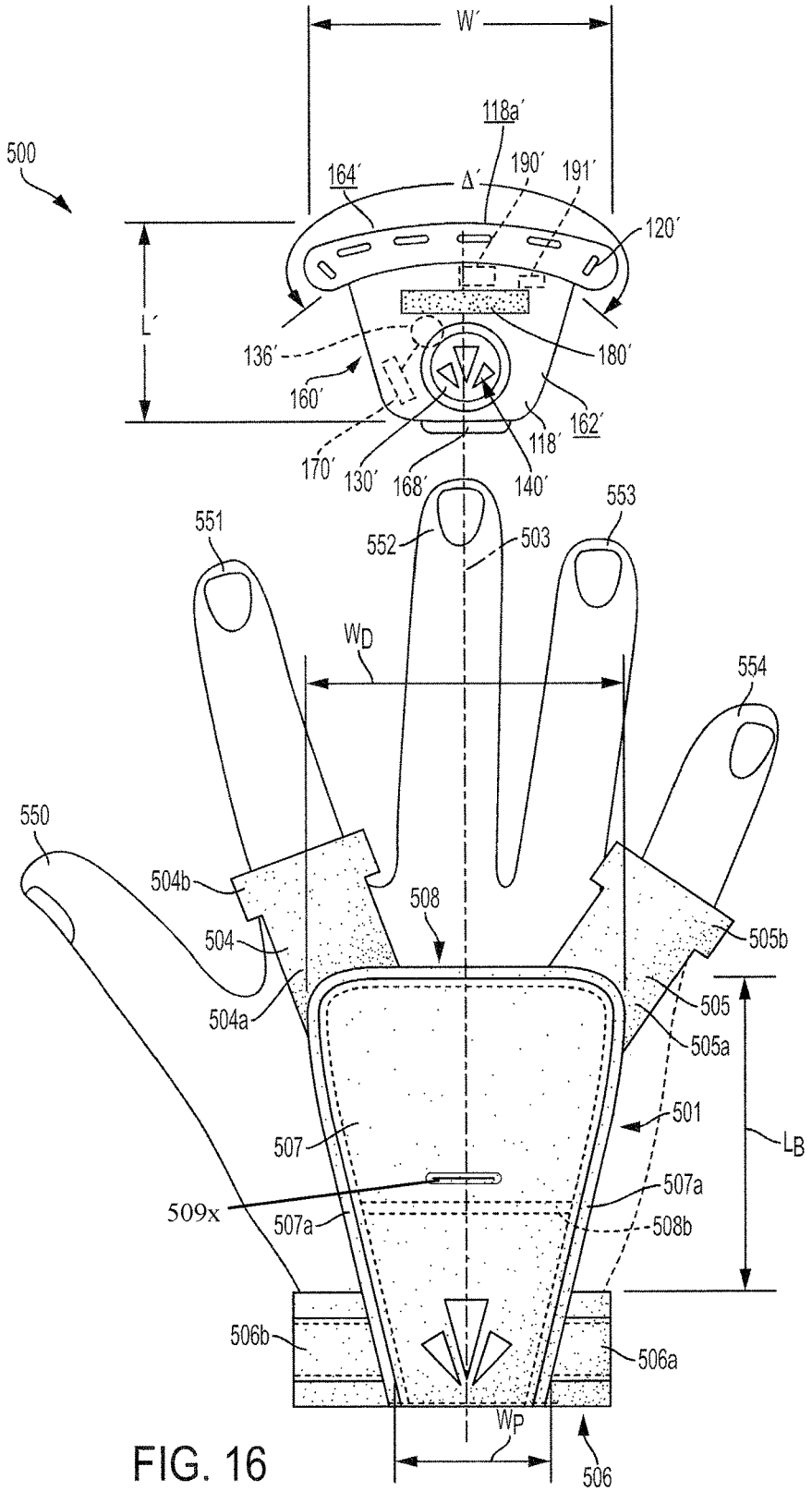
FIG. 16 is top plan view of the glove of FIG. 15, wherein the glove is positioned on the user's hand and the second preferred illumination data controller of FIG. 13A is positioned for use with the fifth preferred glove of FIG. 15.
Figure 17:
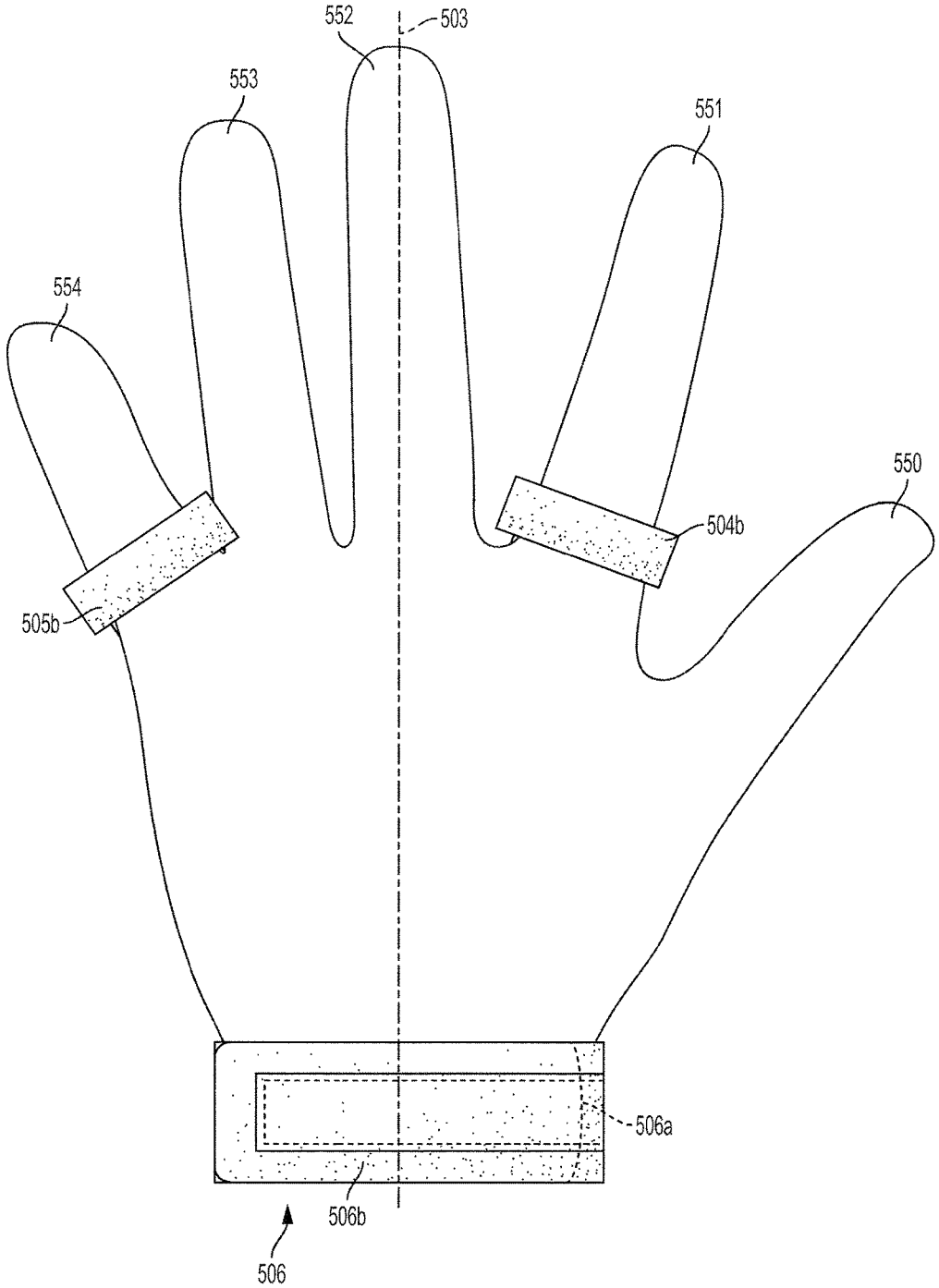
FIG. 17 is bottom plan view of the glove of FIG. 15, wherein the glove is positioned on the user's hand.

Referring to FIGS. 15-17, an illuminated glove assembly 500 in accordance with a fifth preferred embodiment includes a low-profile glove 501 and may utilize any one of the preferred illumination light units 160, 160', 160", 160''' or additional light units adapted for use with the illuminated glove assembly 500. The fifth preferred glove assembly 500 is preferably configured for providing illumination to a user having a pointer finger 551 and a pinky 554. The low-profile glove 501 of the fifth preferred embodiment includes a body portion 502, a longitudinal glove axis 503, a pointer extension 504, a pinky extension 505, a wrist strap 506 and a pocket portion 507. The pocket portion 507 and the body portion 502 preferably define a pocket 508 into which the preferred illumination light units 160, 160', 160", 160''' may be positioned in a working or mounted configuration with the light sources 120, 120', 120", 120''' exposed from the pocket 508 to project light, preferably over the top of the user's knuckles. The glove 501 may also include a D-ring for engagement of items, such as a keyring, to secure the item to the glove 501. The pocket portion 507 may also include a slit or hole 509*x* near the rear stitching 508*b* to provide relatively easy access to the electrical connection port 168', 168''' of the illumination light units 160, 160', 160", 160''' in the mounted configuration by urging a recharging cord through the slit 509*x* and into the electrical connection port 168', 168'''.

The body portion 502 of the illuminated glove assembly 500 of the fifth preferred embodiment has a body length $L_B$, a distal body width $W_D$ and a proximal body width $W_P$. The body length $L_B$ extends substantially between the wrist strap 506 to proximal ends 504*a*, 505*a* of the pointer extension 504 and the pinky extension 505, respectively. The body length LB is measured substantially along the longitudinal axis 503 and the distal and proximal body widths $W_D$, $W_P$ are preferably measured relatively perpendicular to the longitudinal axis 503 at proximal and distal ends of the body portion 502, respectively. The preferred body length $L_B$ is approximately eight to fifteen centimeters (8-15 cm), the preferred proximal body width $W_P$ is approximately three to six centimeters (3-6 cm) and the preferred distal body width $W_D$ is approximately five to eleven centimeters (5-11 cm). The body portion 502 is preferably sized to cover a back of the user's hand between the knuckles and the wrist, but is not so limited and may be otherwise sized and shaped. The body portion 502 of the preferred embodiment has a generally frusta-triangular shape that generally covers a significant portion of the back of the user's hand to support the pocket portion 507 and the illuminated data controllers or illumination light units 160, 160', 160", 160'" of the preferred embodiments. The body portion 502 preferably does not cover the entire hand of the user permitting exposure and cooling of the user's hand and light from the light sources 120, 120', 120", 120'". The body portion 502 may alternatively be placed on the user's palm such that the light sources 120, 120', 120", 120'" project light toward the inside tips of the user's fingers 550, 551, 552, 553, 554 in the mounted configuration. This mounting configuration is preferred for performing tasks near the inside tips of the user's fingers, 550, 551, 552, 553, 554, such as baiting fishing hooks, writing, eating, examining small items or other related tasks in low light conditions. The fifth preferred illuminated glove assembly 500 may be worn in this alternative mounting configuration over a user's base gloves or directly on the user's hand.

The body portion 502 of the preferred low-profile glove 501 is configured such that the distal body width $W_D$ is approximately double the proximal body width $W_P$ to accommodate the illumination light units 160, 160', 160", 160'" with the wider front face 164 than the back or rear portion. The body portion 502 also covers a larger portion of the user's hand near the knuckles when compared to the narrower wrist. The body portion 501 is not so limited and may be otherwise configured to have a generally parallelepiped or curved shape for ornamental or functional purposes. The shape of the body portion 501 shown in FIGS. 15-17 is, however, preferred to support the preferred illumination light units 160, 160', 160", 160'" and provide stability for the light units 160, 160', 160", 160'" on the user's hand.

The glove 501 of the fifth preferred embodiment is preferably constructed at least partially of a breathable material, fluoropolymer fabric, vinyl, a waterproof fabric, a lightweight waterproof fabric, Gore-Tex, CarbonX, Nomex, a fireproof fabric, cotton, heavy canvas, Neoprene, synthetic rubber fabrics, or a combination of cotton and heavy canvas or other related materials. The glove 501 is not so limited and may be constructed of alternative materials and combinations of materials, such as the above-listed materials and reflective materials or other special performance materials for particular uses or based on designer or user preferences.

The pocket portion 507 of the low-profile glove 501 is preferably stitched to the body portion 502, at least along side edges of the body portion 502 and the pocket portion 507 and is also preferably stitched to the wrist strap 506 at a proximal end. The pocket portion 507 is not limited to being stitched to the body portion 502 and the wrist strap 506 and may be adhesively bonded, tacked, integrally formed or otherwise secured to the body portion 502 and the wrist strap 506 to secure the pocket portion 507 to the body portion 502 and the wrist strap 506 and to form the pocket 508 between the pocket portion 507 and the body portion 502. The pocket portion 507 is also not limited to being attached to the wrist strap 506 and may be engaged only to the body portion 502 to define the pocket 508. The pocket portion 507 is preferably not stitched to the body portion 502 along a front or distal edge to provide a mouth or opening for the pocket 508 into which the illumination light units 160, 160', 160", 160'" are inserted.

The wrist strap 506 of the low-profile glove 501 is positioned at a proximal end 501*a* of the glove 501 and the body portion 502 for engagement of the glove 501 with the user's wrist. The wrist strap 506 includes a first end 506*a* and a second end 506*b* that extend away from the body portion 502 and the pocket portion 507 for wrapping around the user's wrist. A wrist strap securing mechanism 509 is connected to wrist strap 506 to releasably secure the first end 506*a* to the second end 506*b* in a mounted configuration to secure the glove 501 to the user's wrist. In the preferred embodiment, the wrist strap securing mechanism 509 is comprised of hook and loop material that is attached to an outer surface of the first end 506*a* and an inner surface of the second end 506*b* for releasably engaging the first end 506*a* to the second end 506*b*. The wrist strap securing mechanism 509 is not limited to being comprised of hook and loop material and may be comprised of nearly any fastening mechanism that releasably secures the first end 506*a* to the second end 506*b* around the user's wrist, such as buttons, zippers, adhesive bonding, ties, fasteners, clamps, binding, belt-type or other fastening mechanisms that permit engagement of the proximal end of the glove 501 to the user's wrist.

The pointer extension 504 and the pinky extension 505 of the low-profile glove 501 of the fifth preferred embodiment extend from a distal end of the body portion 502 substantially along or at a slight outward angle relative to a parallel to the longitudinal glove axis 503 with the pointer extension 504 and the pinky extension 505 angled away from the longitudinal glove axis 503 in the preferred embodiment. The pointer extension 504 is preferably positioned on a first side of the longitudinal axis 503 or on a side associated with the user's pointer finger 551 and the pinky extension 505 is positioned on a second side of the longitudinal axis 503 or on a side associated with the user's pinky finger 554. The pointer extension 504 preferably extends over the user's pointer knuckle and the pinky extension 505 preferably extends over the user's pinky knuckle in the mounted position. The pointer and pinky extensions 504, 505 are not so limited and may be configured to extend over the user's middle and ring finger knuckles or the user's thumb knuckle in alternative configurations. The glove 501 of the fifth preferred embodiment is not limited to including only the pointer and pinky extensions 504, 505 or to being mounted to the pointer and pinky fingers 551, 554 of the user and may be configured with extensions (not shown) that are selectively mountable to the user's thumb 550, middle finger 552 or ring finger 553 or may be otherwise configured for attachment to the user's hand.

The glove 501 of the fifth preferred embodiment includes a pointer loop 504*b* on a distal end of the pointer extension 504 and the pinky extension 505 includes a pointer loop 505*b* on a distal end. The pointer loop 505*b* is configured to mount around a base of the user's pointer finger 551 and the pinky loop 504*b* is configured to mount around a base of the user's pinky finger 554 in the mounted configuration. The pointer and pinky loops 504*b*, 505*b* may be adjustable for tightening relative to the user's fingers and may be loosened relative to the user's fingers, such as by using securing mechanisms, as is described below. The engagement of the pointer and pinky loops 504*a*, 505*a* with the user's pointer and pinky fingers 551, 554 and the wrist strap 506 with the user's wrist secures and mounts the glove 501 to the user's hand in the mounted configuration. The preferred pointer and pinky loops 504*a*, 505*a* are at least partially constructed of an elastic material or elastic band material that biases the pointer and pinky loops 504*a*, 505*a* to an initial pointer loop diameter and an initial pinky loop diameter. The initial pointer loop diameter and the initial pinky loop diameter are preferably slightly smaller than the base of the user's pointer and pinky fingers 551, 554, respectively, such that the elastic stretches and snugly fits the pointer and pinky loops 504*a*, 505*a* to the fingers 551, 554 in the mounted configuration.

The pointer and pinky loops 504*a*, 505*a* are not limited to being constructed at least partially of elastic material and may be integrally formed with the pointer and pinky extensions 504, 505 or may be otherwise configured for securing around the user's fingers, such as through the use of ties, snaps, adhesive bonding, hook and loop material, fasteners or other engagement mechanisms that secure the pointer and pinky extensions 504, 505 to the user's fingers. The pointer and pinky extensions 504, 505 are preferably constructed of the same material as the body portion 502, but are not so limited and may be comprised of a different elastic material, a braided leather material or other material that extends between the body portion 502 and the pointer and pinky extensions 504, 505, respectively, to separate the pointer and pinky loops 505*b*, 504*b* from the body portion 502.

The pointer and pinky loops 504*b*, 505*b* are not limited to being attached to the user's pointer and pinky fingers 551, 554 and may be mounted or attached to any of the user's fingers 550, 551, 552, 553, 554. For example, the user may attach the pointer loop 504*b* to the user' thumb 550 and the pinky loop 505*b* to any of the user's pointer finger 551, middle finger 552, ring finger 553 or pinky finger 554 to direct the light from the light sources 120, 120', 120", 120''' in different directions relative to the user's hand in the mounted configuration. In addition, the glove 501 of the fifth preferred embodiment may be mounted with the pocket portion 507 adjacent the uder's palm, instead of adjacent the back of the user's hand, with the pinky loop 505*b* attached to the user's thumb 550 or pointer finger 551 and the pointer loop 504*b* attached to the user's pinky, ring or middle fingers 554, 553, 552 such that the light sources 120, 120', 120", 120''' are directed toward the inner side of the user's fingers 550, 551, 552, 553, 554 to provide light toward in inner tips of the user's fingers 550, 551, 552, 553, 554. This generally inverted position of the glove 501 of the fifth preferred embodiment may be utilized to provide light toward the inner surfaces of the fingers 550, 551, 552, 553, 554 for performing tasks that require or benefit from light at this area of the user's hand, such as tying hooks when fishing, reading, eating, operating equipment and related tasks where illumination at the inside of the user's fingers is desired. The pointer and pinky loops 504*a*, 505*b* may, therefore, be mounted on any of the user's fingers 550, 551, 552, 553, 554 in the back of the hand or the inverted configurations to direct light in directions and to areas that are desired by the user. Such adjustability of the positioning of the glove 501 of the fifth preferred embodiment is desirable such that the user can modify the orientation of the projection of light from the light sources 120, 120', 120", 120''' relative to the user's hand based on the angle of projection and based on positioning at the back or palm of the hand.

The pocket 508 of the glove 501 of the fifth preferred embodiment is preferably defined by the space between the pocket portion 507 and the body portion 502 and is bounded by the stitching at the sides of the pocket portion near the outer peripheral edge 507*a*, the pocket opening 508*a* and rear stitching 508*b* extending across and defining a rear end of the pocket 508. The pocket portion 507 may terminate at the rear stitching 508*b*, but extends over the wrist strap 506 in the preferred embodiment for aesthetic purposes.

The preferred pocket portion 507 includes an outer peripheral edge 507*a* that is positioned proximate an outer edge of the body portion 502 in the assembled configuration. The pocket portion 507, therefore, has a similar size and shape compared to the body portion 502 at least near the pocket 508 to form the pocket 508 for receipt of the illumination light units or data controllers 160, 160', 160", 160'''. The pocket 508 and, therefore, the body portion 502 and the pocket portion 507 have a similarly tapering shape from the distal end to the proximal end, but are not so limited and may be otherwise shaped and configured. The preferred outer peripheral edge 507*a* of the pocket portion 507 includes a reflective material engaged thereto to provide a reflective safety feature for the glove 501, although the glove 501 is not so limited and may include a decorative material on its periphery or may include a plain material.

The pocket 508 preferably includes a pocket opening 508*a* proximate a distal end 502*b* of the body portion 502 and the pocket portion 507. The pocket opening 508*a* is preferably formed between the body portion 502 and the pocket portion 507 by not stitching the front or distal end 502*b* to the pocket portion 507. The pocket opening 508*a* may be held in a closed position (FIG. 15) by a hook and loop material 510 attached to the inside surfaces of the body portion 502 and the pocket portion 507. The hook and loop material 510 may also be used to assist in securing the illumination light units or data controllers 160, 160', 160", 160''' in the pocket 508 in the mounted configuration by engaging the engagement mechanism 180, 180', 180", 180'''. The glove 501 is not limited to including the hook and loop material 510 and the illumination light units or data controllers 160, 160', 160", 160''' may be otherwise secured in the pocket 508 and the pocket 508 may be secured in the closed position without the hook and loop material 510, but the hook and loop material is preferred for this dual function. The hook and loop material 510 may alternatively be comprised of fasteners, clips, clamps, magnets, adhesive or other fastening mechanisms that are able to secure the pocket 508 in the closed position and engage the illumination light units or data controllers 160, 160', 160", 160''' when they are inserted into the pocket 508. The body portion 502 and pocket portion 507 may also be constructed of an elastic material such that the pocket 508 is able to expand and contract to engage the illumination light units or data controllers 160, 160', 160", 160''' and move to the closed configuration without employing secondary engagement or fastening mechanisms, such as the hook and loop material 510.

The fifth preferred glove 501 is adaptable for use with a liner glove 801, which is described in greater detail below, as a base layer with the glove 502 mounted over the liner glove 801. The fifth preferred glove 501 may also be mounted to the user's hand over a favorite pair of relatively low-profile gloves, such as running or cycling gloves, so that the user is able to use their preferred gloves and benefit from the lighting and other features of the preferred illumination light units or data controllers 160, 160', 160", 160'''. Accordingly, the fifth preferred glove 501 may be used in relatively cold climates and conditions with a base glove, such as the liner glove 801, or may also be used in relatively warm or hot climates or conditions by mounting the fifth preferred glove 501 and preferred illumination light units or data controllers 160, 160', 160", 160''' directly to the user's hand. The fifth preferred gloves 501 are particularly favorable for runners or cyclists in warm climates that want to run or bike in cooler dark times of the day, thereby requiring light, but do not want to wear full gloves that overheat the user's hand. Accordingly, the glove 501 is particularly adaptable for both cold and warm climates, as well as climates that experience all four seasons.

Figure 18:
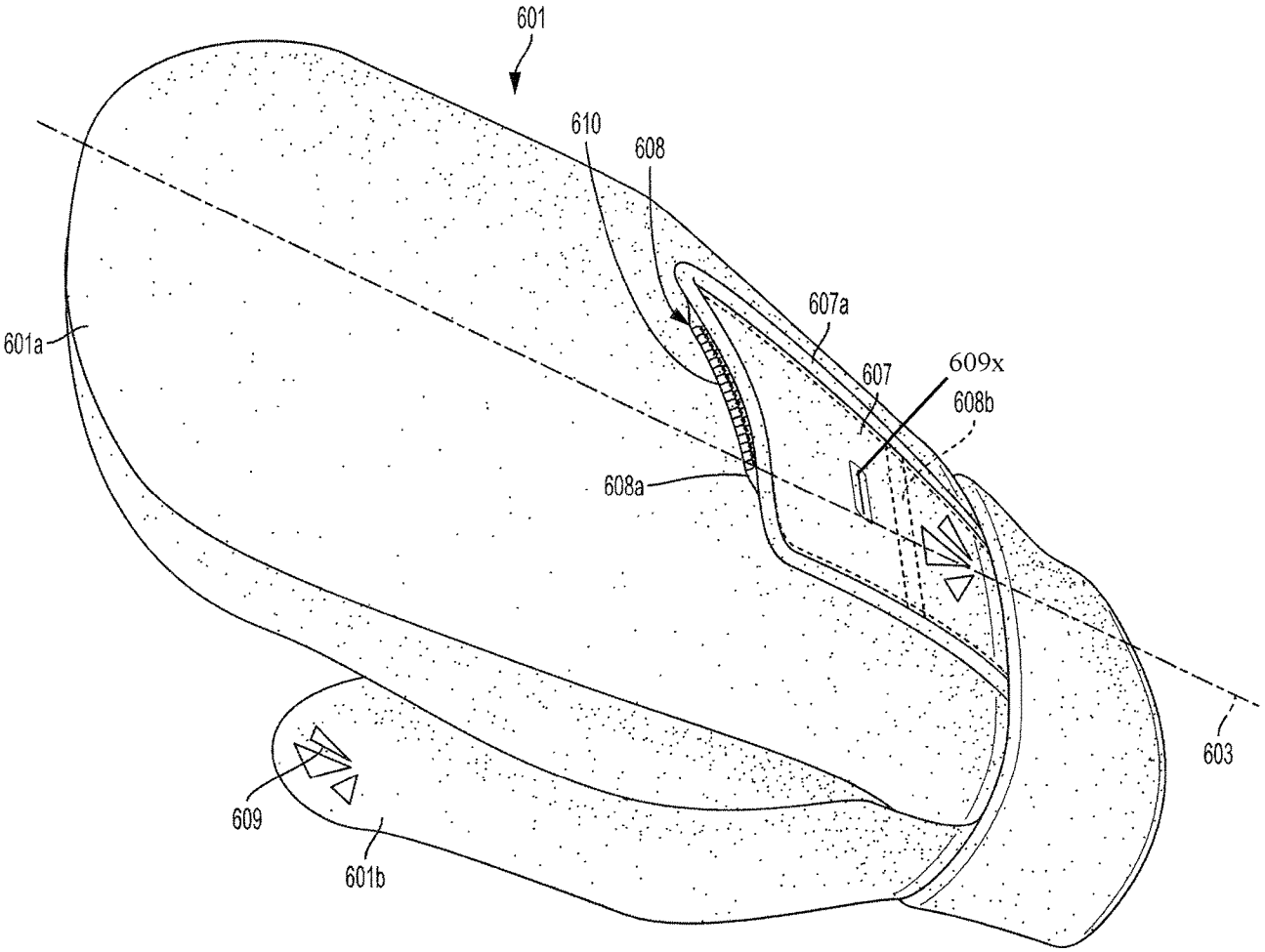
FIG. 18 is a top perspective view of a glove for an illuminated glove assembly in accordance with a sixth preferred embodiment of the present invention.
Figure 19:
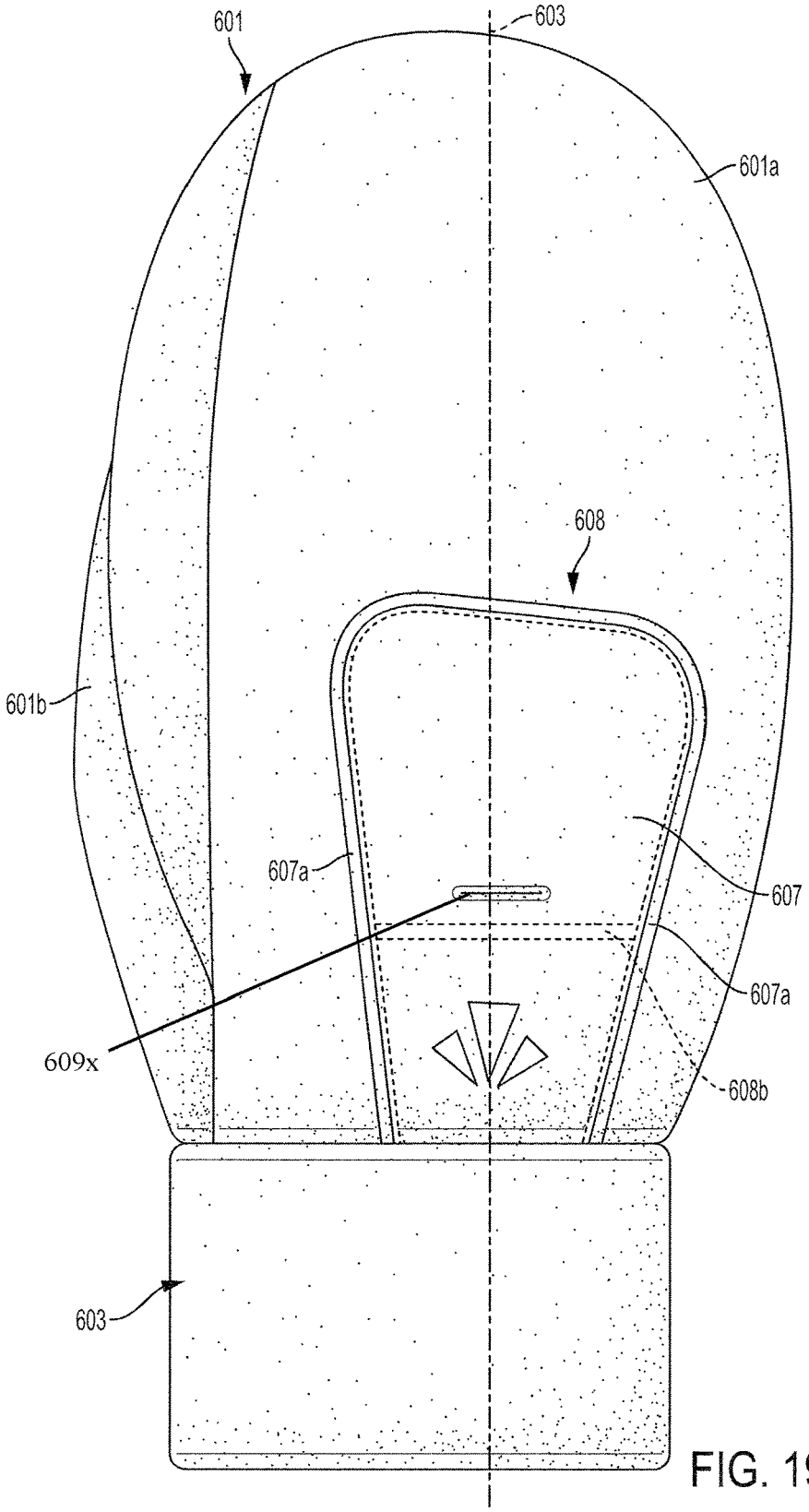
FIG. 19 is top plan view of the glove of FIG. 18.
Figure 20:
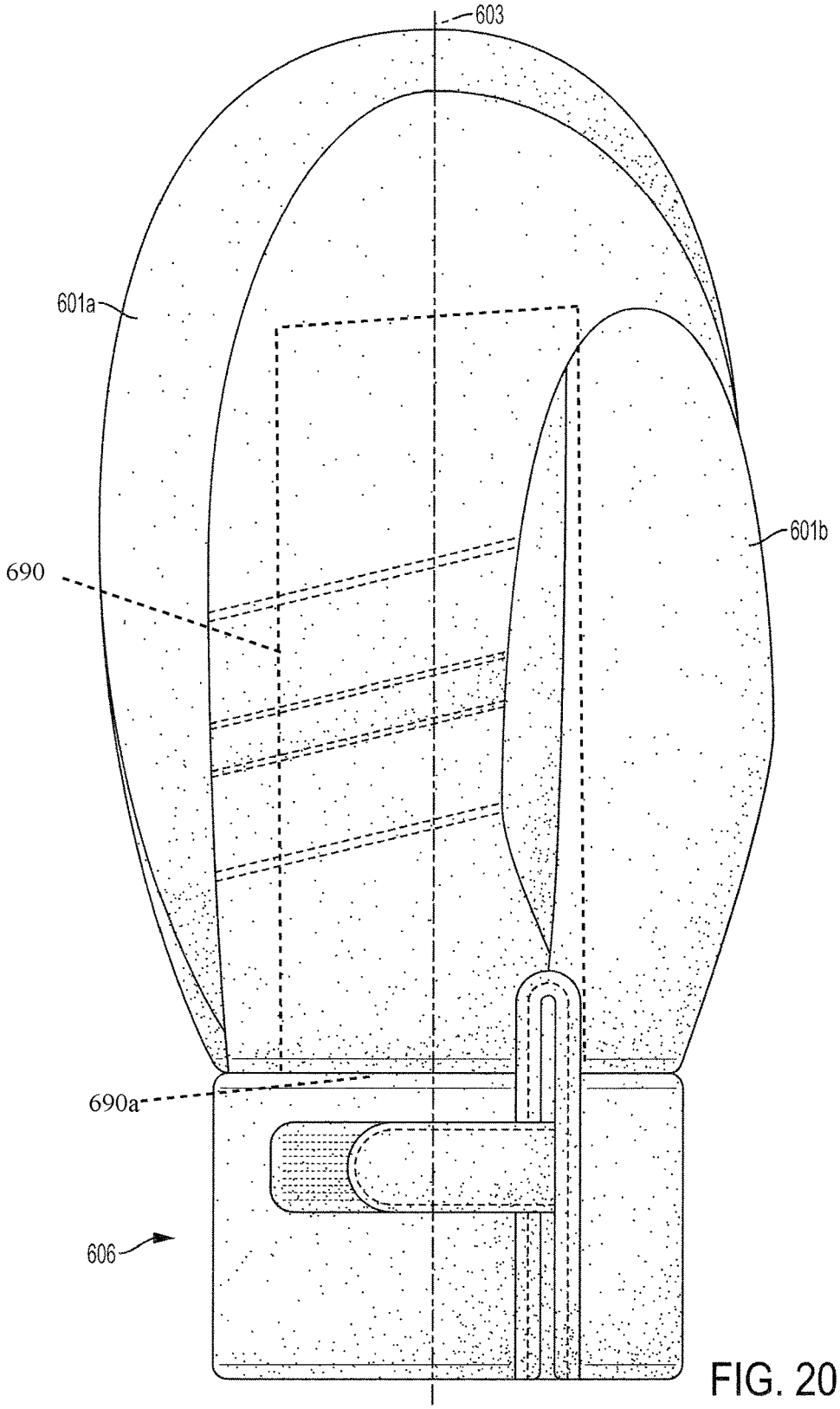
FIG. 20 is a bottom plan view of the glove of FIG. 18.

Referring to FIGS. 18-20, a sixth preferred embodiment of an illuminated glove assembly includes a mitten glove 601 with a body 601*a* and a thumb 601*b*. The mitten glove 601 includes a pocket portion 607 attached to the body 601*a* that has similar features and functions when compared to the pocket portion 507 of the fifth preferred embodiment and similar reference numbers are used to identify similar features with a "6" prefix to distinguish the features of the sixth preferred embodiment. The pocket portion 607 of the sixth preferred embodiment is preferably stitched to the body 601*a* proximate the sides of the outer peripheral edge 607*a* and along the rear stitching 608*b* to define the pocket 608 with the pocket opening 608*a* along the front of the pocket portion 607 wherein the pocket portion 607 is not stitched to the body 601*a*. The hook and loop material 610 may be disengaged, thereby opening the pocket 608 for insertion of any one of the illumination light units or data controllers 160, 160', 160", 160'". In the working or mounted configuration, the front face 118*a*, 118*a'*, 118*a"*, 118*a'"* of the housing 118, 118', 118", 118'" is exposed from the pocket opening 608*a* such that the light sources 120, 120', 120", 120'" emanate light over the user's knuckles when the illumination light units or data controllers 160, 160', 160", 160'" are turned on.

The mitten glove 601 also preferably includes a conductive tab 609 on a tip of the thumb 601*b* and may also include additional conductive tabs or portions (not shown) where a user's finger tips are positioned when the glove 601 is mounted to the user's hand. The conductive tab 609 is designed and configured to permit the user to operate touchscreens while wearing the glove 601. The mitten glove 601 is not limited to inclusion of the conductive tab 609 on the tip of the thumb 601*b* and may forgo the conductive tab 609 or may include multiple conductive tabs 609 positioned at locations on the glove 601 that are convenient for a user to operate touchscreens with their fingers or thumb. The conductive tab 609 may also be adapted for use with any of the other preferred gloves 10, 110, 210, 402, 501, 601, 701, 802 described herein such that the user is able to operate a touchscreen while wearing the gloves 10, 110, 210, 402, 501, 601, 701, 802, wherein the conductive tab 609 is preferably attached to the material of the gloves 10, 110, 210, 402, 501, 601, 701, 802. The pocket portion 607 of the mitten glove 601 may also include a slit or hole 609*x* near the rear stitching 508*b* to provide relatively easy access to the electrical connection port 168', 168'" of the illumination light units 160, 160', 160", 160' in the mounted configuration by urging a recharging cord through the slit 509*x* and into the electrical connection port 168', 168'".

Referring to FIGS. 14B and 20, the rower glove 402 and the mitten glove 601 also preferably include an inner pocket 490, 690 (shown in dashed linetype) mounted or located on an inner surface of the palm portion of the rower glove 402 and the mitten glove 601. The inner pocket 490, 690 preferably contains an opening 490*a*, 690*a* near the wrist portion 603 of the mitten glove 601. A heating pouch can be inserted into the inner pocket 490, 690 through the openings 490*a*, 690*a* to warm a user's hand. The pocket 490, 690 is preferably constructed between insulating layers of the gloves 402, 601 such that the heating pouch is not in direct contact with the user's hand and is secured to the rover or mitten glove 402, 601 in a mounted configuration.

Figure 21:
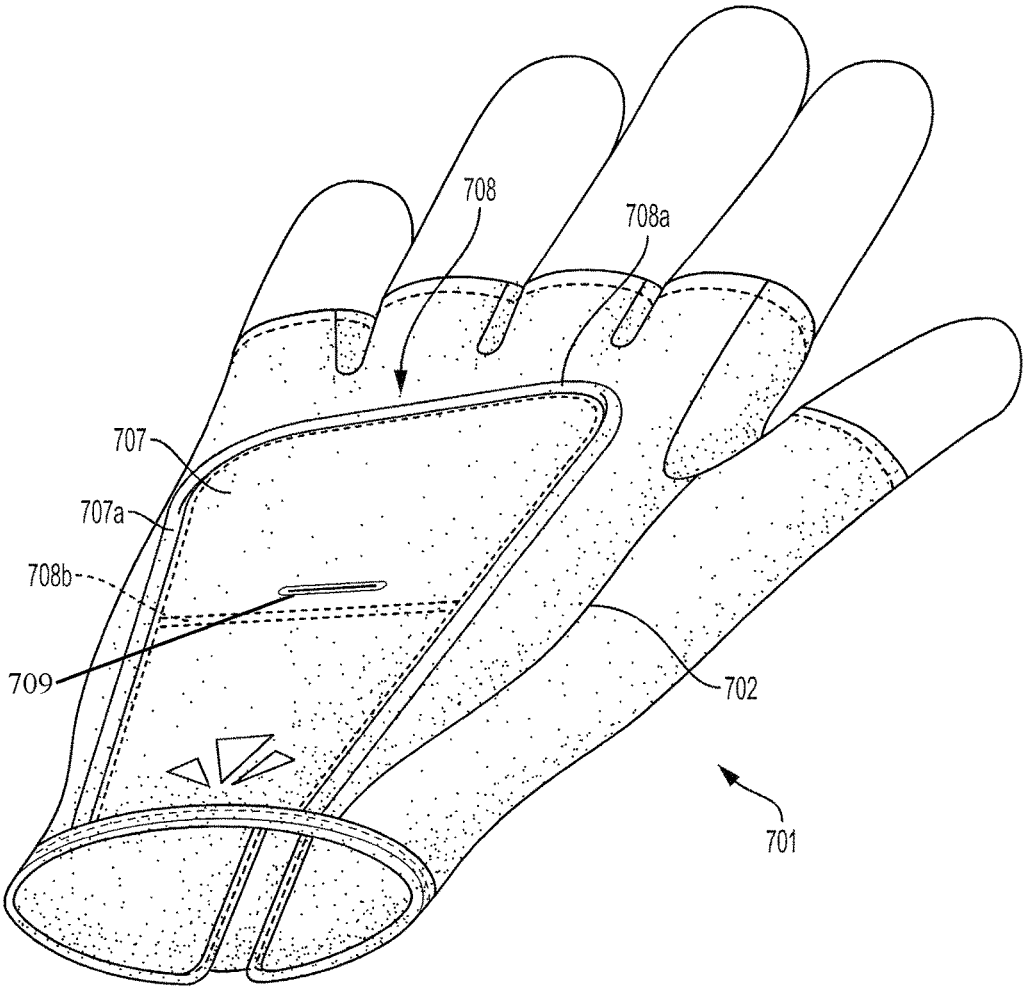
FIG. 21 is a top perspective view of a glove for an illuminated glove assembly in accordance with a seventh preferred embodiment of the present invention.
Figure 22:
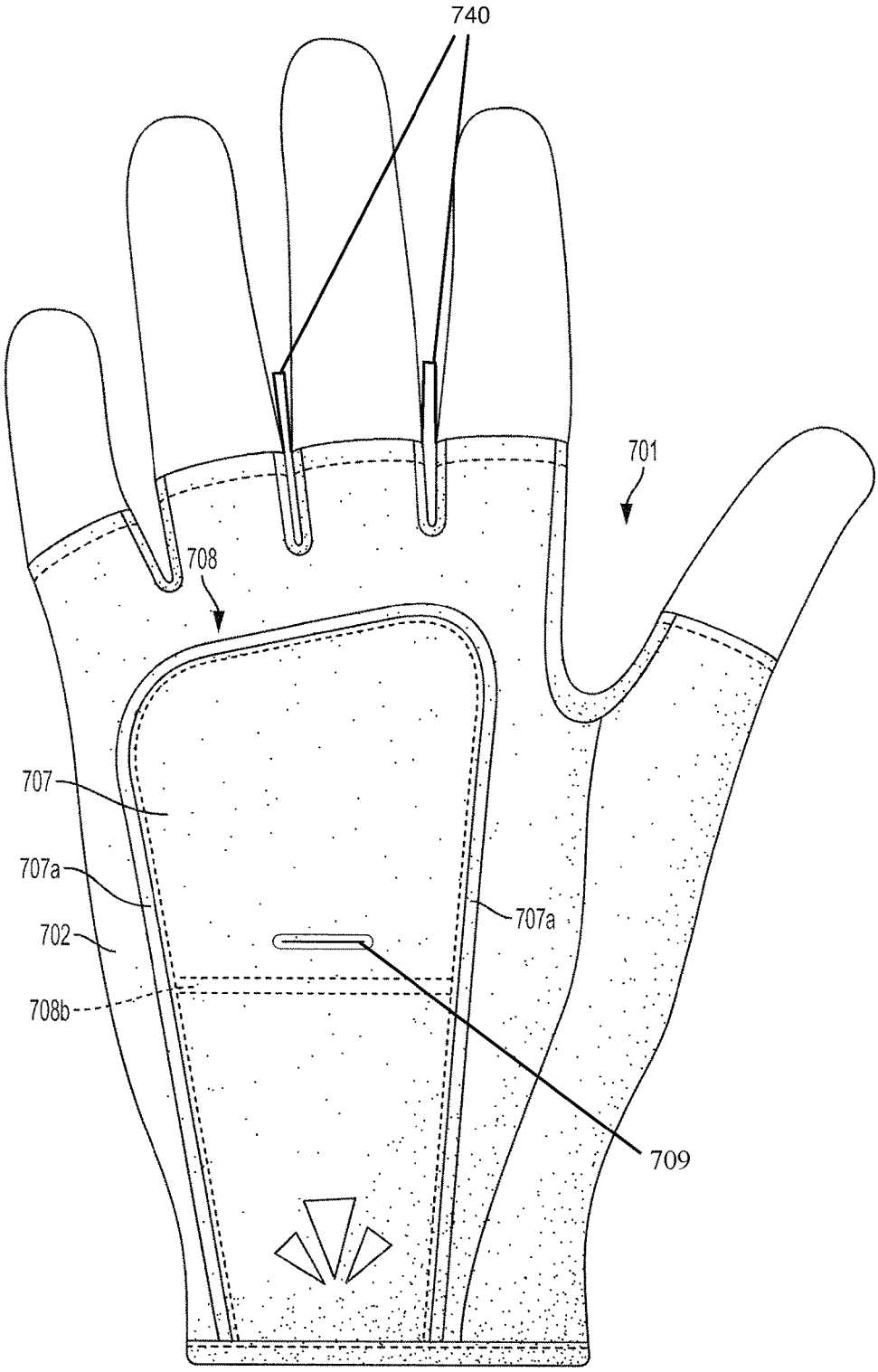
FIG. 22 is a top plan view of the glove of FIG. 21.
Figure 23:
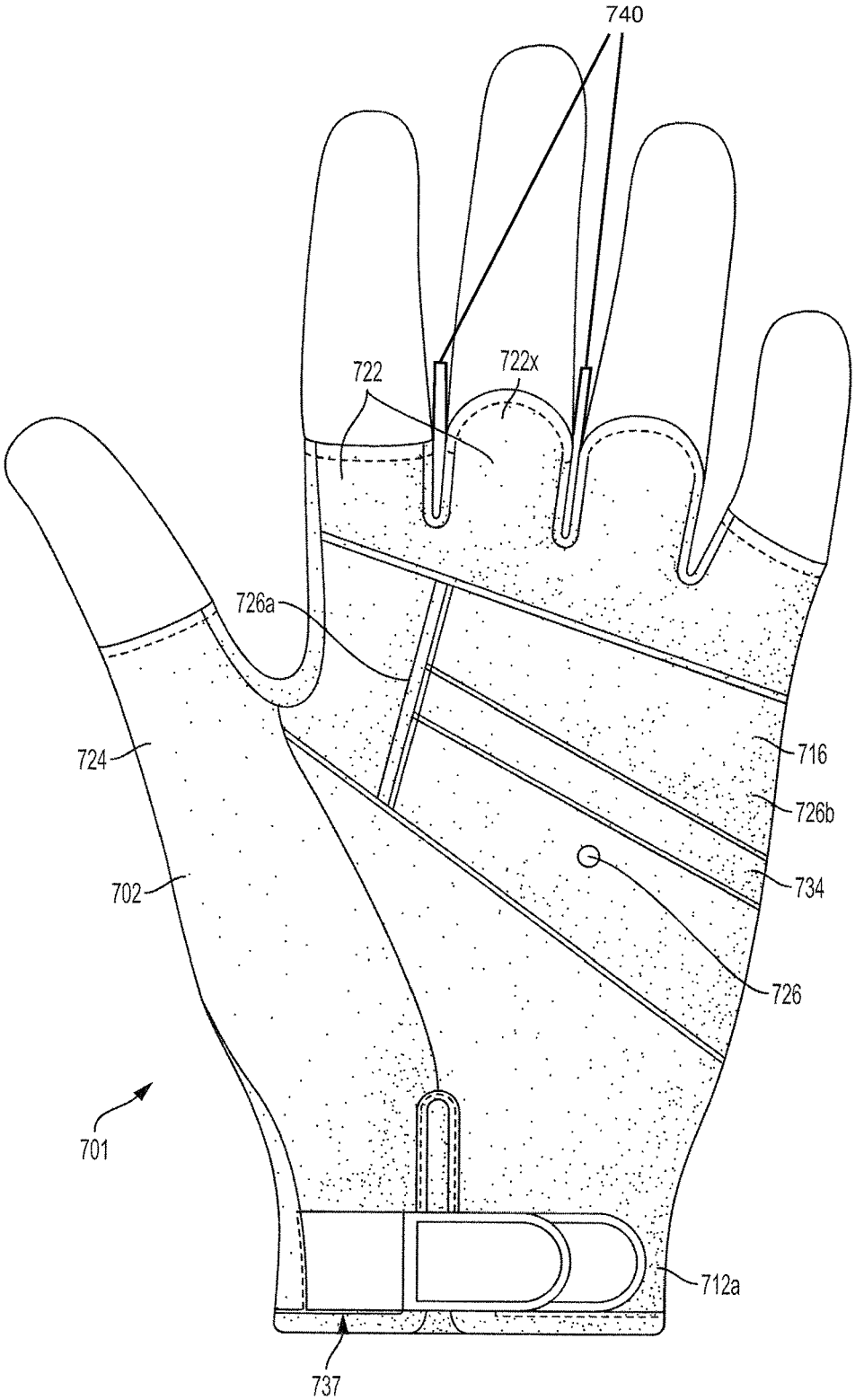
FIG. 23 is a bottom plan view of the glove of FIG. 21.

Referring to FIGS. 21-23, a seventh preferred embodiment of an illuminated glove assembly includes a half glove 701 with a body portion 702 having half fingers and a palm portion. The half glove 701 includes a pocket portion 707 attached to the body 702 that has similar features and functions when compared to the pocket portions 507, 607 of the fifth and sixth preferred embodiments and similar reference numbers are used to identify similar features with a "7" prefix to distinguish the features of the seventh preferred embodiment. The pocket portion 707 of the seventh preferred embodiment is preferably stitched to the body portion 702 proximate the sides of the outer peripheral edge 707*a* and along the rear stitching 708*b* to define the pocket 708 with the pocket opening 708*a* along the front of the pocket portion 707. The pocket portion 707 is preferably not stitched to the body portion 702 along the front edge, thereby forming the pocket opening 708*a*. The illumination light units or data controllers 160, 160', 160", 160'" may be inserted into the pocket 708 during use. In this working or mounted configuration, the front face 118*a*, 118*a'*, 118*a"*, 118*a'"* of the housing 118, 118', 118", 118'" is exposed from the pocket opening 708*a* such that the light sources 120, 120', 120", 120'" emanate light over the user's knuckles when the illumination light units or data controllers 160, 160', 160", 160'" are turned on. The pocket portion 707 may also include a slit or hole 709 near the rear stitching 708*b* to provide relatively easy access to the electrical connection port 168', 168'" of the illumination light units 160, 160', 160", 160' in the mounted configuration.

The palm portion 716 of the seventh preferred glove 701 also has similar features when compared to the palm portion 116 of the glove 110 of the second preferred embodiment and similar reference numbers are used to describe the features of the palm portion 716 of the seventh preferred embodiment with a "7" prefix distinguishing the seventh preferred palm portion features. The palm portion 716 of the seventh preferred embodiment includes the second pocket 726 with the second opening 726*a* near the thumb 724 of the body portion 702 and the second terminal end 726*b*. The palm portion 716 also includes a reflective strap 734 extending across the palm portion 716 and the second pocket 726 that is coated with or includes reflective material for safety. The user may insert items into the second pocket 726 for storage, such as keys or other relatively small items.

The seventh preferred glove 701 also includes half or partial fingers 722, but is not so limited and may include full or no fingers. A pair of elongated portions 722*x* preferably extends from the middle and ring fingers on a palm side of the glove 701 that may be grasped by a user to assist in removing the glove 701 from the user's hand. The glove 701 is not limited to including the pair of elongated portions 722*x* and may include only a single elongated portion 722*x*, may include elongated portions 722*x* on other fingers 722 or may be configured without the elongated portions 722*x*, without significantly impacting the configuration and operation of the seventh preferred glove 701.

The seventh preferred glove 701 also preferably includes finger pulls 740 located between two or more of the half or partial fingers 722. The finger pulls 740 may be grapsed by a user to assist in removing the glove 701 from the user's hand. The finger pulls 740 are preferably located between the index and middle finger of the glove 701 and between the middle and ring finger of the glove 701, but may be configured in only one of these locations or may also be located between the ring and pinky finger of the glove 701 or the thumb and pointer fingers of the glove 701. The finger pulls 740 are preferably constructed of an elastic fabric material, but are not so limited and may be constructed of any material suitable for their purpose. In use, the elastic fabric material preferably flexes so that the fingers are movable relative to each other and may expand to permit a user to insert there opposite finger(s) beneat the finger pulls 740 to assist in removing the glove 701 from the user's hand.

Figure 24A:
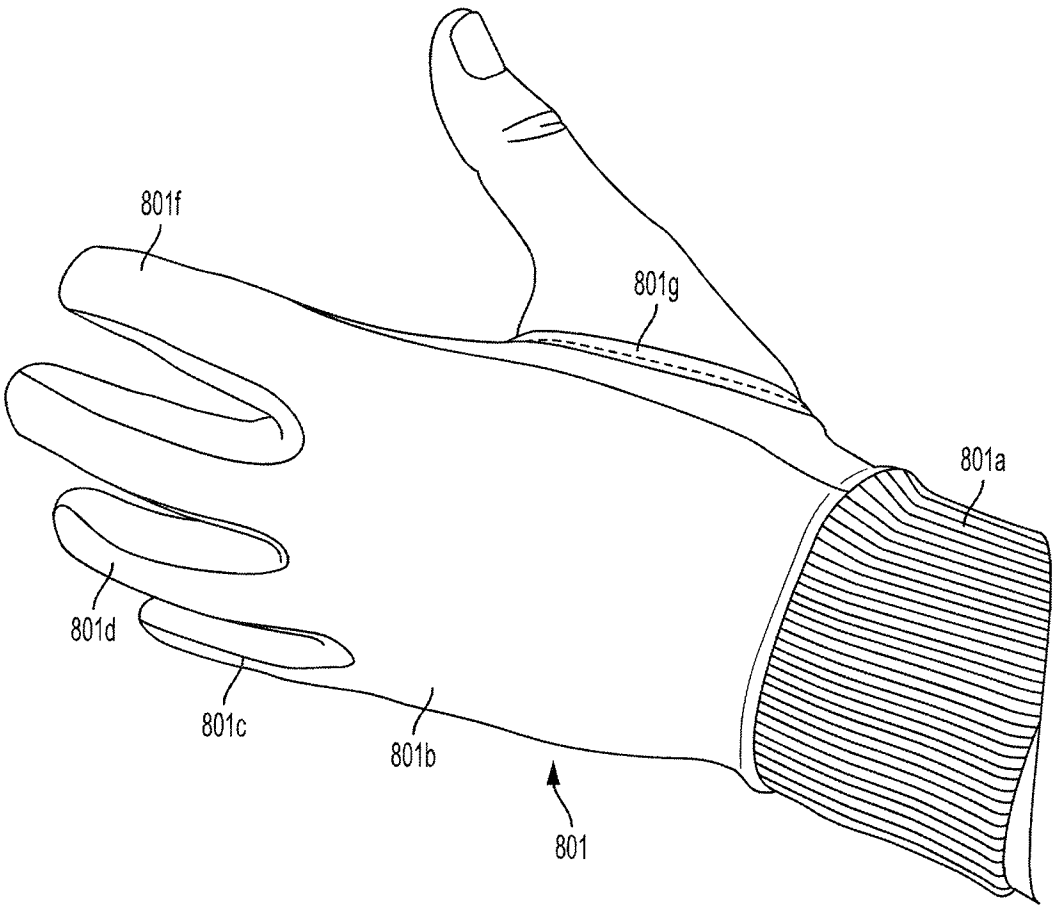
FIG. 24A is a top perspective view of a liner glove in accordance with an eighth preferred embodiment of the present invention that may be utilized with the preferred glove assemblies described herein.
Figure 24B:
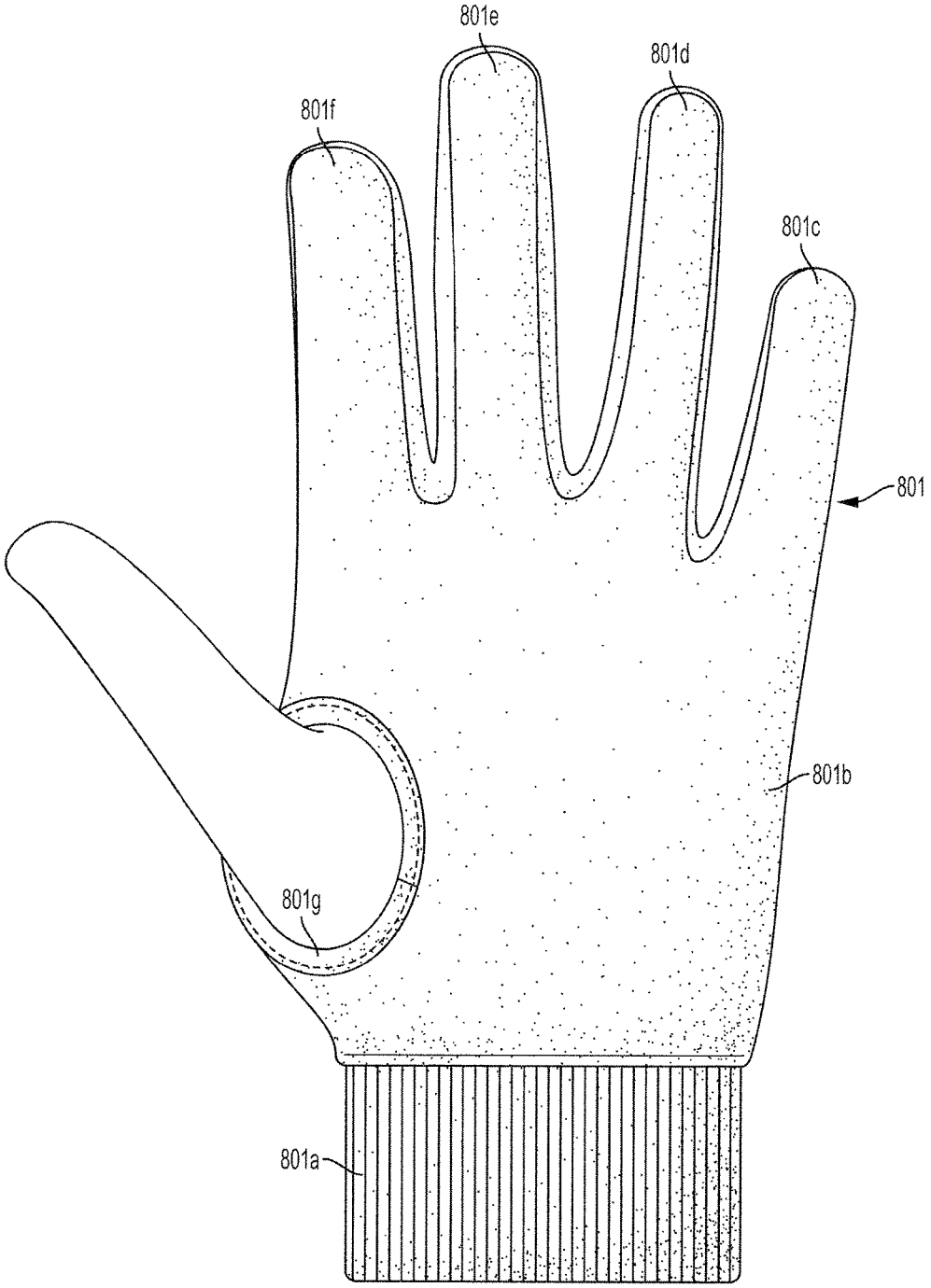
FIG. 24B is a bottom plan view of the liner glove of FIG. 24A.

Referring to FIGS. 24A and 24B, a liner glove 801 may be utilized in an assembly with any of the preferred gloves 10, 110, 210, 402, 501, 601, 701, 802, described herein, or may be utilized separately, as will be apparent to one having ordinary skill in the art based on a review of the present disclosure. The liner glove 801 is preferably constructed of a relatively flexible or elastic material and includes a wrist portion 801*a*, a hand portion 801*b*, four finger portions including a pinky finger 801*c*, a ring finger 801*d*, a middle finger 801*e* and a pointer finger 801*f* and a thumb hole 801*g*. The flexible material of the liner glove 801 preferably fits the user's hand relatively tightly such that the material generally tracks or conforms to the surface of the user's skin. The wrist portion 801*a* is preferably constructed of an elastic or elasticized material and may be ribbed to engage the user's wrist in a mounted configuration. The thumb hole 801*g* is preferably configured to permit the user's thumb to extend out of the liner glove 801. The liner glove 801 may be particularly useful or preferred in combination with the mitten glove 601 to provide additional coverage and warmth for the user's hand. The liner glove 801 may alternatively be utilized with the rower glove 402 and provide additional warmth for the user's hand, particularly in view of the side hole 402*c* that permits additional inflow of cold air when compared to a typical mitten.

The liner glove 801 is not limited to being utilized with the mitten glove 601 or the rower glove 402 and may be utilized with other preferred gloves described herein or nearly any glove or hand wrap, such as the low-profile glove 501. The liner glove 401 is preferably utilized as a base layer that may be combined with other layers to keep a user's hands warm. When used with the rower glove 402, the liner glove 801 may be used when the user is not rowing for warmth and may be removed when the user is rowing such that the user's hands directly contact the paddle or oar.

The liner glove 801 may also be used independently of any other glove, such as by being worn by a user in cool environments or by a runner who is creating their own body heat. The liner glove 801 may further be utilized with an outer glove and the outer glove may be removed as the user's hand becomes warm, such as by a runner who heats or becomes warmer during a run. The liner glove 801 preferably includes the four fingers 801*c*, 801*d*, 801*e*, 801*e* to cover and keep the user's fingers warm, but includes the thumb hole 801*g* such that the user's thumb is exposed from the liner glove 801 in the mounted configuration. The liner glove 801 is specifically designed to counteract Raynaud's disease, which is relatively prevalent in runners and other endurance athletes. A user's fingers feel numb and cold in response to cold temperatures or stress when suffering from Raynaud's disease, as smaller arteries that supply blood to skin narrow at the extremities, resulting in limited blood circulation in the fingers. Arteries in the thumb are comparatively larger and, therefore, circulation in the thumb is marginally stronger. Accordingly, the liner glove 801 covers and warms the impacted fingers, but permits exposure of the thumb such that the user has more freedom of use of the thumb while wearing the liner glove 801. The thumb hole 801*g* is preferably configured to wrap around the users hand near the knuckle of the thumb, but is not so limited and may be larger or smaller than the thumb hole 801*g* shown in FIGS. 24A and 24B. The wrist portion 801*a* is preferably constructed of a material that is elastic, conforms to and engages the user's wrist to secure the liner glove 801 to the user's hand, but is not so limited and may be constructed of alternative, non-elastic materials and the liner glove 801 may be constructed without the wrist portion 801*a* without significantly impacting the function of the liner glove 801.

Figure 25:
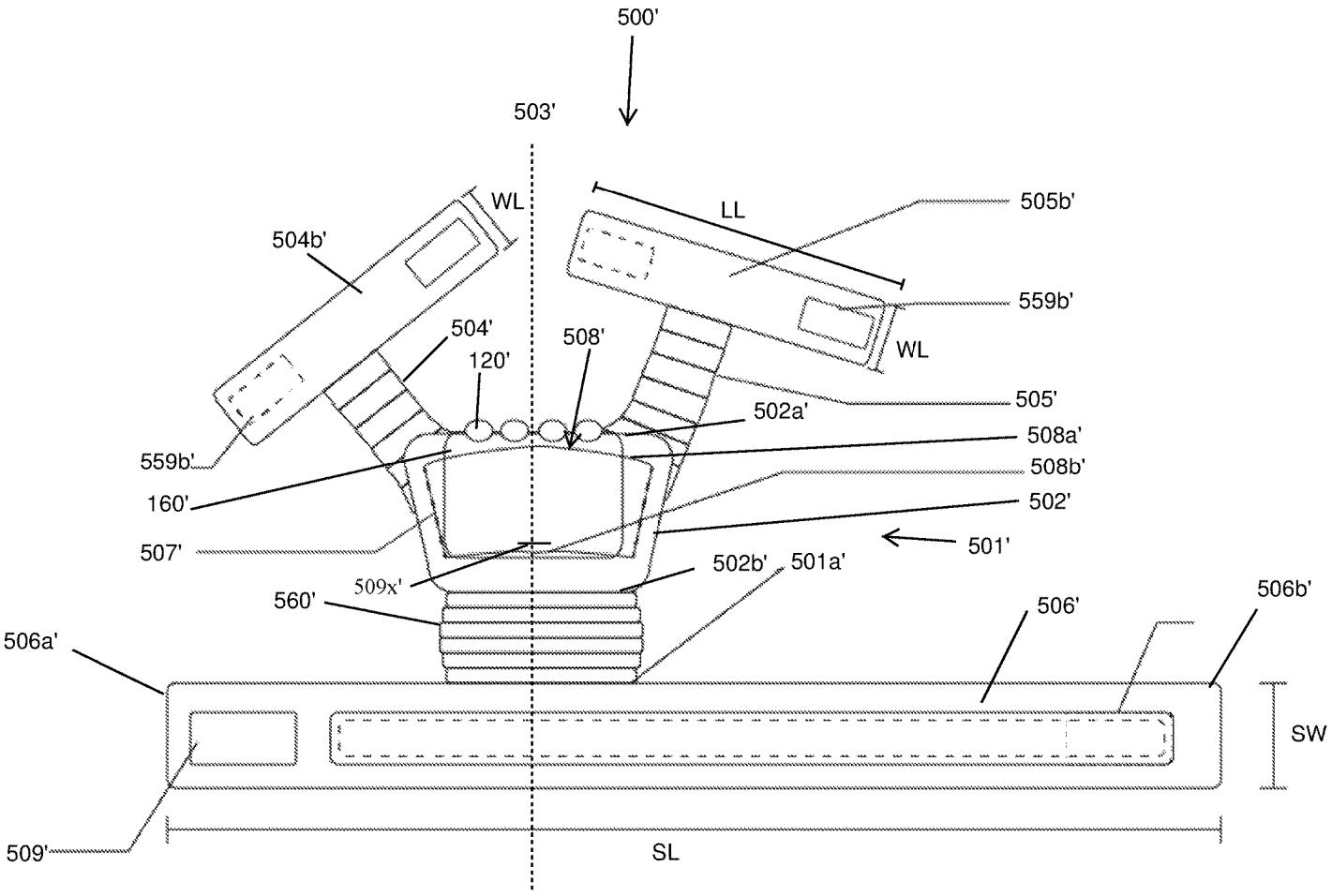
FIG. 25 is a top plan view of a glove for an illuminated glove assembly in accordance with an eighth preferred embodiment of the present invention, wherein the glove is expanded and removed from the user's hand

Referring to FIG. 25, an illuminated glove assembly 500' is shown in accordance with an eighth preferred embodiment that may utilize any one of the preferred illumination light units 160, 160', 160", 160'", or additional light units adapted for use with the glove assembly 500'. Similar to the fifth preferred embodiment of the glove assembly 500, the eighth preferred glove assembly 500' is preferably configured for providing illumination to a user having a pointer finger 551 and a pinky 554. The same reference numerals are utilized to identify the same or similar features of the eighth preferred illuminated glove assembly 500' with a prime symbol ("") utilized to distinguish the features of the eighth preferred glove assembly 500' from the fifth preferred glove assembly 500. The low-profile glove 501' of the eighth preferred embodiment includes a body portion 502', a longitudinal glove axis 503', a pointer extension 504', a pinky extension 505', a wrist strap 506' and a pocket portion 507'. The pocket portion 507' and the body portion 502' preferably define a pocket 508' into which the preferred illumination light units 160, 160', 160", 160'" may be positioned in a working or mounted configuration with the light sources 120, 120', 120", 120'" exposed from the pocket 508' to project light, preferably over the top of the user's knuckles, but is not so limited and may be worn to project light from the user's palm.

The glove 501' of the eighth preferred embodiment is preferably constructed at least partially of a breathable material, fluoropolymer fabric, vinyl, a waterproof fabric, a lightweight waterproof fabric, Gore-Tex, CarbonX, Nomex, a fireproof fabric, cotton, heavy canvas, Neoprene, synthetic rubber fabrics, or a combination of cotton and heavy canvas or other related materials. The glove 501' is not so limited and may be constructed of alternative materials and combinations of materials, such as the above-listed materials and reflective materials or other special performance materials for particular uses or based on designer or user preferences. The glove 501' of the eighth preferred embodiment may also be constructed of materials typical of work or industrial gloves for industrial work, such as leather, animal hide, canvas, chore, nylon, Kevlar, durable polymeric materials, Neoprene or other related materials or may be coated with materials that improve the durability of the glove 501', such as polyvinyl chloride ("PVC"), polyurethane, nitrile, neoprene, latex or other related coatings. The eighth preferred glove 501' may be particularly designed and configured for industry-specific purposes, such as in the power, construction, maintenance, construction, highway maintenance, tree service, lumber or related industries.

The pocket portion 507' of the eighth preferred embodiment of the low-profile glove 501' is preferably stitched to the body portion 502' along side edges of the body portion 502' and the pocket portion 507', but is preferably open at the proximal end near the wrist strap 506'. The pocket portion 507' is not limited to being stitched to the body portion 502' and may be adhesively bonded, tacked, integrally formed or otherwise secured to the body portion 502' to secure the pocket portion 507' to the body portion 502' and to form the pocket 508' between the pocket portion 507' and the body portion 502'. The pocket portion 507' is also preferably not stitched to the body portion 502' along a front or distal edge to provide a mouth or opening for the pocket 508' into which the illumination light units 160, 160', 160", 160'" are inserted.

The wrist strap 506' of the eighth preferred embodiment of the low-profile glove 501' is positioned at a proximal end 501*a'* of the glove 501' and the body portion 502' for engagement of the glove 501' with the user's wrist. The wrist strap 506' is preferably attached to the body portion 502' by a flexible fabric portion 560', but is not so limited and may be attached to the body portion 502' by any suitable means. The wrist strap 506' includes a first end 506*a*' and a second end 506*b*' that extend away from the body portion 502' and the pocket portion 507' for wrapping around the user's wrist. A wrist strap securing mechanism 509' is connected to wrist strap 506' to releasably secure the first end 506*a*' to the second end 506*b*' in a mounted configuration to secure the glove 501' to the user's wrist. In the preferred embodiment, the wrist strap securing mechanism 509' is comprised of hook and loop material that is attached to an outer surface of the first end 506*a*' and an inner surface of the second end 506*b*' for releasably engaging the first end 506*a*' to the second end 506*b*'. The wrist strap securing mechanism 509' is not limited to being comprised of hook and loop material and may be comprised of nearly any fastening mechanism that releasably secures the first end 506*a*' to the second end 506*b*' around the user's wrist, such as buttons, zippers, adhesive bonding, ties, fasteners, clamps, binding, belt-type or other fastening mechanisms that permit engagement of the proximal end of the glove 501' to the user's wrist. The wrist strap securing mechanism 509' may also be comprised of a D-ring that attaches to the first or second ends 506*a*', 506*b*', thereby permitting the opposing first or second end 506*a*', 506*b*' to extend through the D-ring and secure to itself, preferably with hook and loop material. The wrist strap 506' has a strap length $S_L$ preferably about ten inches (10") and a strap width $S_W$ preferably about one inch (1"), but is not so limited.

The pointer extension 504' and the pinky extension 505' of the low-profile glove 501' of the eighth preferred embodiment extend from a distal end of the body portion 502' substantially along or at a slight outward angle relative to a parallel to the longitudinal glove axis 503' with the pointer extension 504' and the pinky extension 505' angled away from the longitudinal glove axis 503' in the preferred embodiment. The pointer extension 504' is preferably positioned on a first side of the longitudinal axis 503' or on a side associated with the user's pointer finger 551 and the pinky extension 505' is positioned on a second side of the longitudinal axis 503' or on a side associated with the user's pinky finger 554. The pointer extension 504' preferably extends over the user's pointer knuckle and the pinky extension 505' preferably extends over the user's pinky knuckle in the mounted position. The pointer and pinky extensions 504', 505' are not so limited and may be configured to extend over the user's middle and ring finger knuckles or the user's thumb knuckle in alterative configurations. The glove 501' of the eighth preferred embodiment is not limited to including only the pointer and pinky extensions 504', 505' or to being mounted to the pointer and pinky fingers 551, 554 of the user and may be configured with extensions (not shown) that are selectively mountable to the user's thumb 550, middle finger 552 or ring finger 553 or may be otherwise configured for attachment to the user's hand.

The glove 501' of the eighth preferred embodiment includes a pointer loop 504*b*' on a distal end of the pointer extension 504' and the pinky extension 505' includes a pointer loop 505*b*' on a distal end. The pointer loop 505*b*' is configured to mount around a base of the user's pointer finger 551 and the pinky loop 504*b*' is configured to mount around a base of the user's pinky finger 554 in the mounted configuration. The engagement of the pointer and pinky loops 504*b*', 505*b*' with the user's pointer and pinky fingers 551, 554 and the wrist strap 506' with the user's wrist secures and mounts the glove 501' to the user's hand in the mounted configuration. The preferred pointer and pinky loops 504*b*', 505*b*' each preferably contain pointer and pinky loop securing mechanisms 559*b*' for securing one end of each pointer and pinky loop 504*b*', 505*b*' to the other end. The securing mechanisms 559*b*' are preferably comprised of a hook and loop material, but are not so limited and may be comprised of any releasable fastening material such that the pointer and pinky loops 504*b*', 505*b*' snugly fit the the fingers 551, 554 in the mounted configuration or draw string loops that may be selectively loosened or tightened depending on the size of loop required by the user. The pointer and pinky loops 504*b*', 505*b*' have a loop width $W_L$ of preferably approximately five-eighths of one inch (⅝") and a loop length $L_L$ of preferably approximately two and one-half to three inches (2.5-3"), but are not so limited. The pointer and pinky extensions 504', 505' are preferably constructed of the same material as the body portion 502', but are not so limited and may be comprised of a different elastic material, a braided leather material or other material that extends between the body portion 502' and the pointer and pinky extensions 504', 505', respectively, to separate the pointer and pinky loops 504*b*', 505*b*', from the body portion 502'. The pointer and pinky loops 505*b*', 504*b*' are also not limited to being connected to the user's pointing and pinky fingers and may be connected to other fingers, such as the pointer loop 505*b*' being attached to the user's thumb in a mounted configuration.

The pointer and pinky loops 504*b*', 505*b*' of the glove 501' of the eighth preferred embodiment are not limited to being attached to the user's pointer and pinky fingers 551, 554 and may be mounted or attached to any of the user's fingers 550, 551, 552, 553, 554. For example, the user may attach the pointer loop 504*b*' to the user's thumb 550 and the pinky loop 505*b*' to any of the user's pointer finger 551, middle finger 552, ring finger 553 or pinky finger 554 to direct the light from the light sources 120, 120', 120", 120'" in different directions relative to the user's hand in the mounted configuration. In addition, the glove 501' of the eighth preferred embodiment may be mounted with the pocket portion 507' adjacent to the user's palm, instead of adjacent the back of the user's hand, with the pinky loop 505*b*' attached to the user's thumb 550 or pointer finger 551 and the pointer loop 504*b*' attached to the user's pinky, ring or middle fingers 554, 553, 552 such that the light sources 120, 120', 120", 120'" are directed toward the inner side of the user's fingers 550, 551, 552, 553, 554 to provide light toward in inner tips of the user's fingers 550, 551, 552, 553, 554. This generally inverted position of the glove 501' of the eighth preferred embodiment may be utilized to provide light toward the inner surfaces of the fingers 550, 551, 552, 553, 554 for performing tasks that require or benefit from light at this area of the user's hand, such as tying hooks when fishing, reading, eating, operating equipment and related tasks where illumination at the inside of the user's fingers is desired. The pointer and pinky loops 504*a*', 505*b*' may, therefore, be mounted on any of the user's fingers 550, 551, 552, 553, 554 in the back of the hand or the inverted configurations to direct light in directions and to areas that are desired by the user. Such adjustability of the positioning of the glove 501' of the eighth preferred embodiment is desirable such that the user can modify the orientation of the projection of light from the light sources 120, 120', 120", 120'" relative to the user's hand based on the angle of projection and based on positioning at the back or palm of the hand. The adjustability of the pointer and pinky loops 504*a*', 505*b*' also accommodate mounting to each of the user's fingers 550, 551, 552, 553, 554 by permitting adjustment of size to snuggly fit onto any of the user's fingers 550, 551, 552, 553, 554.

The pocket 508' of the glove 501' of the eighth preferred embodiment is preferably defined by the space between the pocket portion 507' and the body portion 502' and is bounded by the stitching at the sides of the pocket portion near the outer peripheral edge 507*a*', the front pocket opening 508*a*' and the rear pocket opening 508*b*'. The preferred pocket portion 507' includes an outer peripheral edge 507*a*' that is positioned proximate an outer edge of the body portion 502' in the assembled configuration. The pocket portion 507', therefore, has a similar size and shape compared to the body portion 502', at least near the pocket 508', to form the pocket 508' for receipt of the illumination light units or data controllers 160, 160', 160", 160'". The pocket 508' and, therefore, the body portion 502' and the pocket portion 507' have a similarly tapering shape from the distal end to the proximal end, but are not so limited and may be otherwise shaped and configured. The pocket portion 507' of the glove 501' may also include a slit or hole 509*x*' near the rear stitching 508*b*' to provide relatively easy access to the electrical connection port 168', 168'" of the illumination light units 160, 160', 160", 160'" in the mounted configuration by urging a recharging cord through the slit 509*x*' and into the electrical connection port 168', 168'".

The pocket 508' preferably includes a front pocket opening 508*a*' proximate a distal end 502*a*' of the body portion 502' and the pocket portion 507'. The pocket 508' preferably further includes a rear pocket opening 508*b*' proximate a proximal end 502*b*' of the body portion 502' and the pocket portion 507'. The front pocket opening 508*a* and rear pocket opening 508*b*' are preferably formed between the body portion 502' and the pocket portion 507' by not stitching the front or distal end 502*a*' or the rear or proximal end 502*b*' to the pocket portion 507'. The rear pocket opening 508*b*' is preferably located to provide access to any charging or data ports (not shown) that may be present on the rear of the illumination light units or data controllers 160, 160', 160", 160'" in the pocket 508'. The front pocket opening 508*a*' and/or rear pocket opening 508*b*' may be held in a closed position (not shown) by a hook and loop material (not shown) attached to the inside surfaces of the body portion 502' and the pocket portion 507'. The hook and loop material may also be used to assist in securing the illumination light units or data controllers 160, 160', 160", 160'" in the pocket 508' in the mounted configuration by engaging the engagement mechanism 180, 180', 180", 180'". The glove 501' is not limited to including the hook and loop material 510' and the illumination light units or data controllers 160, 160', 160", 160'" may be otherwise secured in the pocket 508' and the pocket 508' may be secured in the closed position without the hook and loop material, but the hook and loop material is preferred for this dual function. The hook and loop material may alternatively be comprised of fasteners, clips, clamps, adhesive or other fastening mechanisms that are able to secure the pocket 508' in the closed position and engage the illumination light units or data controllers 160, 160', 160", 160'" when they are inserted into the pocket 508'. The body portion 502' and pocket portion 507' may also be constructed of an elastic material such that the pocket 508' is able to expand and contract to engage the illumination light units or data controllers 160, 160', 160", 160'" and move to the closed configuration without employing secondary engagement or fastening mechanisms, such as the hook and loop material.

It will be appreciated by those skilled in the art that changes could be made to the embodiments described above without departing from the broad inventive concept thereof. For example, the various components and features of the first, second and third preferred embodiments of the glove 10 may be mixed and matched or incorporated together as desired by a user or designer. For example, the window 28 of the first preferred embodiment of the glove 10 may be incorporated into the gloves 110, 210 of the second and third preferred embodiments, the first pocket 270 may be includes in the first and second preferred gloves 10, 110, the window 28 may be employed with the second and third preferred gloves 110, 210, any of the preferred gloves 10, 110, 210 may include full or partial fingers 22, the preferred illumination data controllers 160, 160', 160", 160'" may be mounted in the first preferred glove 10, the arcuate front face 164' of the second preferred embodiment of the illumination data controllers 160', 160'" may be utilized with the first and third preferred illumination data controllers 160, 160" and other mixing and matching of the features of the gloves 10, 110, 210 and illumination data controllers 160, 160', 160", 160'" may be employed. The illuminated data controllers 160, 160', 160", 160'" and gloves 10, 110, 210, 402, 501, 601, 701, 802 may also be configured such that the data controllers 160, 160', 160", 160'" are mounted in different locations or are mountable in multiple locations on the gloves 10, 110, 210, 402, 501, 601, 701, 802 such as at the user's palm or on the back of the user's hand. The preferred gloves 10, 110, 210, 402, 501, 601, 701, 802 fit relatively snuggly or close-fitting to the user's hand to reduce or eliminate bouncing or sliding of the glove and attached illumination data controllers 160, 160', 160", 160'" relative to the user's hand to provide significant control of the direction of illumination emanating from the illumination data controllers 160, 160', 160", 160'". It is understood, therefore, that this invention is not limited to the particular embodiments disclosed, but it is intended to cover modifications within the spirit and scope of the present invention as defined by the present disclosure.

I claim:

1. An illuminated glove assembly for providing illumination to a user, the illuminated glove assembly comprising:

a glove including a hand portion, the hand portion including a back portion, fingers, a wrist end and a palm portion, the back portion including a first pocket, the first pocket including a first opening proximate the fingers and a first terminal end proximate the wrist end; and an illumination data controller configured for selective mounting in the first pocket in a mounted configuration, the illumination data controller including a housing with a front face, a top surface, a length, a width and a thickness, the front face including a light source from which light emanates, the width being greater than the thickness and the length being greater than the thickness, the top surface including an engagement mechanism thereon, the engagement mechanism securing the illumination data controller in the first pocket in a mounted configuration by engaging the glove proximate the first opening such that the light source is directed outwardly and over the fingers, the top surface also including a control button thereon, the light source configured to activate by depressing the control button.

2. The illuminated glove assembly of claim 1, wherein the first pocket includes an engagement mechanism at the first opening in the first pocket, the engagement mechanism on the top surface contacting the engagement mechanism in the first pocket to secure the illumination data controller in the first pocket in the mounted configuration.

3. The illuminated glove assembly of claim 1, wherein the fingers extend from the hand portion approximately to a wearer's first knuckle, the hand portion also including a thumb extending therefrom between the fingers and the wrist end.

4. The illuminated glove assembly of claim 1, wherein the palm portion is constructed of a sheer material and includes a second pocket, the second pocket including a second opening proximate a thumb and a second terminal end proximate a side of the hand portion opposite the thumb.

5. The illuminated glove assembly of claim 1, wherein the light source includes at least four light emitting diodes.

6. The illuminated glove assembly of claim 1, wherein the glove is constructed of one of a nylon material and a suede material, a finger pull positioned between the fingers.

7. The illuminated glove assembly of claim 1, wherein the illumination data controller is self-contained and includes an alarm and a wireless transmitter, the wireless transmitter configured for communication with other wireless receivers and transmitters to send and receive data.

8. The illuminated glove assembly of claim 1, wherein the illumination data controller includes a circuit board and a microchip in communication with the light source, the circuit board and microchip configured to control operation of the light source.

9. The illuminated glove assembly of claim 8, wherein the circuit board and microchip are comprised of a chip mounted on board-variety unit.

10. The illuminated glove assembly of claim 1, wherein the at least four light emitting diodes are selected from the group consisting of a surface mounted display variety and a chip on board variety.

11. The illuminated glove assembly of claim 1, wherein the palm portion includes gripping dots configured to facilitate gripping and grasping items.

12. The illuminated glove assembly of claim 1, wherein the hand portion is constructed of a material selected from the group consisting of polyester, spandex, dri-wicking material, polar fleece and combinations thereof.

13. The illuminated glove assembly of claim 1, wherein the palm portion and the fingers are constructed of a synthetic suede material, a middle finger of the fingers includes an elongated portion to facilitate removal of the glove from the user's hand.

14. The illuminated glove assembly of claim 1, wherein the illumination data controller includes a power source, the power source connected to the at least four light emitting diodes to selectively illuminate the at least four light emitting diodes.

15. The illuminated glove assembly of claim 1, wherein the illumination data controller includes a power source, the power source is selected from the group consisting of a piezoelectric power source, a solar power source, a battery, a rechargeable battery and a lithium ion battery.

16. The illuminated glove assembly of claim 1, wherein the glove is constructed at least partially of a material selected from the group consisting of a breathable material, fluoropolymer fabric, vinyl, a waterproof fabric, a lightweight waterproof fabric, Gore-Tex, CarbonX, Nomex, a fireproof fabric, cotton, heavy canvas and a combination of cotton and heavy canvas.

17. The illuminated glove assembly of claim 1, wherein the illumination data controller includes an electrical connection port at a rear of the housing.

18. The illuminated glove assembly of claim 17, further comprising:

a battery mounted within the housing, the electrical connection port is configured for selectively recharging the battery.

19. The illuminated glove assembly of claim 1, further comprising:

a circuit board mounted in the illumination data controller, the circuit board configured to selectively activate the light source in one of a flashing and a blinking pattern to improve the user's ability to be seen.

20. The illuminated glove assembly of claim 1, wherein the engagement mechanism is comprised of hook and loop material.

* * * * *